US009260667B2

(12) United States Patent
Gao et al.

(10) Patent No.: US 9,260,667 B2
(45) Date of Patent: *Feb. 16, 2016

(54) COMBINED PROCESS OF HYDROTREATING AND CATALYTIC CRACKING OF HYDROCARBON OILS

(75) Inventors: Yongcan Gao, Beijing (CN); Chaogang Xie, Beijing (CN); Chuanfeng Niu, Beijing (CN); Jiushun Zhang, Beijing (CN); Lishun Dai, Beijing (CN); Hong Nie, Beijing (CN); Dadong Li, Beijing (CN); Jun Long, Beijing (CN); Jianguo Ma, Beijing (CN); Yan Cui, Beijing (CN)

(73) Assignees: China Petroleum & Chemical Corporation, Beijing (CN); Research Institute of Petroleum Processing, Sinopec, Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/618,759

(22) Filed: Sep. 14, 2012

(65) Prior Publication Data

US 2013/0062250 A1 Mar. 14, 2013

Related U.S. Application Data

(63) Continuation of application No. 12/809,516, filed as application No. PCT/CN2008/002033 on Dec. 19, 2008.

(30) Foreign Application Priority Data

Dec. 20, 2007 (CN) ..... 2007 1 0179984
Mar. 20, 2008 (CN) ..... 2008 1 0102302

(51) Int. Cl.
*C10G 11/00* (2006.01)
*C10G 11/18* (2006.01)
(Continued)

(52) U.S. Cl.
CPC ..... *C10G 11/18* (2013.01); *C10G 11/182* (2013.01); *C10G 51/06* (2013.01); *C10G 69/04* (2013.01);
(Continued)

(58) Field of Classification Search
CPC ..... C10G 11/00; C10G 11/10; C10G 11/12–11/18; C10G 11/182; C10G 51/026; C10G 2300/1059
USPC ..... 208/78, 80
See application file for complete search history.

(56) References Cited

U.S. PATENT DOCUMENTS 2,687,988 A * 8/1954 Stratford et al. ..... 208/150
2,776,930 A 1/1957 McKeague et al.
(Continued)

FOREIGN PATENT DOCUMENTS

CN 1025216 C 6/1994
CN 1211470 A 3/1999
(Continued)

OTHER PUBLICATIONS

Haitao et al., "Improving of Feedstock Filters for Residue Hydrotreating Unit", *Petroleum Refinery Engineering*, vol. 31(5), 2001, 4 pages.
(Continued)

*Primary Examiner* — Michelle Stein
(74) *Attorney, Agent, or Firm* — Finnegan, Henderson, Farabow, Garrett & Dunner, LLP

(57) ABSTRACT

Disclosed is a combination process for improved hydrotreating and catalytic cracking of hydrocarbon oils, including: contacting residual oil, catalytic cracking cycle oil, and optional distillate oil with a hydrotreating catalyst under hydrotreating conditions in the presence of hydrogen followed by separation of the reaction products to obtain hydrogenated tail oil and other products; contacting the hydrogenated tail oil and optional normal catalytic cracking feedstock oil with a cracking catalyst under catalytic cracking conditions followed by separation of the reaction products; wherein the hydrogenated tail oil and/or normal catalytic cracking feedstock oil are separated into at least two fractions prior to contacting the hydrogenated tail oil and/or normal catalytic cracking feedstock oil with the cracking catalyst.

21 Claims, 3 Drawing Sheets

(51) Int. Cl.
*C10G 51/06* (2006.01)
*C10G 69/04* (2006.01)

(52) U.S. Cl.
CPC .. *C10G 2300/107* (2013.01); *C10G 2300/1037* (2013.01); *C10G 2300/1077* (2013.01); *C10G 2300/301* (2013.01); *C10G 2300/4006* (2013.01); *C10G 2300/4012* (2013.01); *C10G 2300/70* (2013.01); *C10G 2300/807* (2013.01); *C10G 2400/02* (2013.01); *C10G 2400/04* (2013.01); *C10G 2400/28* (2013.01)

(56) References Cited

U.S. PATENT DOCUMENTS

| | | | | |
|---|---|---|---|---|
| 2,906,694 | A * | 9/1959 | Dunlap et al. | 208/97 |
| 3,617,497 | A | 11/1971 | Bryson et al. | |
| 3,775,290 | A | 11/1973 | Peterson et al. | |
| 4,090,948 | A * | 5/1978 | Schwarzenbek | 208/78 |
| 4,565,620 | A | 1/1986 | Montgomery et al. | |
| 4,713,221 | A * | 12/1987 | Montgomery et al. | 208/80 |
| 4,859,309 | A | 8/1989 | De Vries et al. | |
| 5,080,777 | A | 1/1992 | Aegerter, Jr. et al. | |
| 5,108,580 | A | 4/1992 | Nongbri et al. | |
| 5,152,883 | A | 10/1992 | Melin et al. | |
| 5,154,818 | A | 10/1992 | Harandi et al. | |
| 5,840,178 | A | 11/1998 | Huang et al. | |
| 6,123,830 | A | 9/2000 | Gupta et al. | |
| 6,416,656 | B1 * | 7/2002 | Zhang et al. | 208/113 |
| 6,495,028 | B1 | 12/2002 | Xu et al. | |
| 6,565,739 | B2 | 5/2003 | Winter | |
| 6,569,315 | B2 | 5/2003 | Stuntz et al. | |
| 6,620,311 | B2 | 9/2003 | Morel et al. | |
| 8,529,753 | B2 | 9/2013 | Niu et al. | |
| 2005/0006279 | A1 | 1/2005 | Gueret et al. | |
| 2011/0062054 | A1 | 3/2011 | Gao et al. | |

FOREIGN PATENT DOCUMENTS

| | | | |
|---|---|---|---|
| CN | 1237477 | A | 12/1999 |
| CN | 1262306 | A | 8/2000 |
| CN | 1279270 | A | 1/2001 |
| CN | 1351113 | A | 5/2002 |
| CN | 1382776 | A | 12/2002 |
| CN | 1400285 | A | 3/2003 |
| CN | 1400288 | A | 3/2003 |
| CN | 1191334 | C | 3/2005 |
| CN | 1202219 | C | 5/2005 |
| CN | 1626625 | A | 6/2005 |
| CN | 1648212 | A | 8/2005 |
| CN | 1648215 | A | 8/2005 |
| CN | 1670135 | A | 9/2005 |
| CN | 1690172 | A | 11/2005 |
| CN | 1782031 | A | 6/2006 |
| CN | 1814705 | A | 8/2006 |
| CN | 1814707 | A | 8/2006 |
| CN | 1854251 | A | 11/2006 |
| CN | 1854254 | A | 11/2006 |
| CN | 101161786 | A | 4/2008 |
| CN | 101323798 | A | 12/2008 |
| EP | 0372632 | | 6/1990 |
| EP | 1734098 | A1 | 12/2006 |
| GB | 1 557 955 | | 12/1979 |
| JP | 2002-534559 | | 10/2002 |
| JP | 2003-503580 | | 1/2003 |
| JP | 2004-501223 | | 1/2004 |
| JP | 2004-501224 | | 1/2004 |
| JP | 2004-059775 | | 2/2004 |
| JP | 2007-527937 | | 10/2007 |
| WO | WO 01/79382 | A2 | 10/2001 |
| WO | WO 01/79393 | A2 | 10/2001 |
| WO | WO 01/79394 | A2 | 10/2001 |
| WO | WO 02/102938 | A1 | 12/2002 |
| WO | WO 2009/089681 | | 7/2009 |

OTHER PUBLICATIONS

"The Necessity of Processing Sour Residual Oil by Residue Hydrotreating—catalytic Cracking Combined Process", *Chemical Engineering of Oil & Gas*, vol. 34, No. 4, Aug. 2005, pp. 265-267.

International Search Report for International Application No. PCT/CN2008/002033, dated Mar. 26, 2009, from the State Intellectual Property Office, the P.R. China.

Wang, Feng, et al., "Processing Technology and Progress of the FCC Slurry", Contemporary Chemical Industry, vol. 32, No. 1, Mar. 2003, pp. 45-49.

Liu, Cunzhu, et al., "Application of Continuous Filtration Technique for Slurry From RFCCU", Petroleum Refinery Engineering, vol. 31, No. 1, Jan. 2001, pp. 32-34.

* cited by examiner

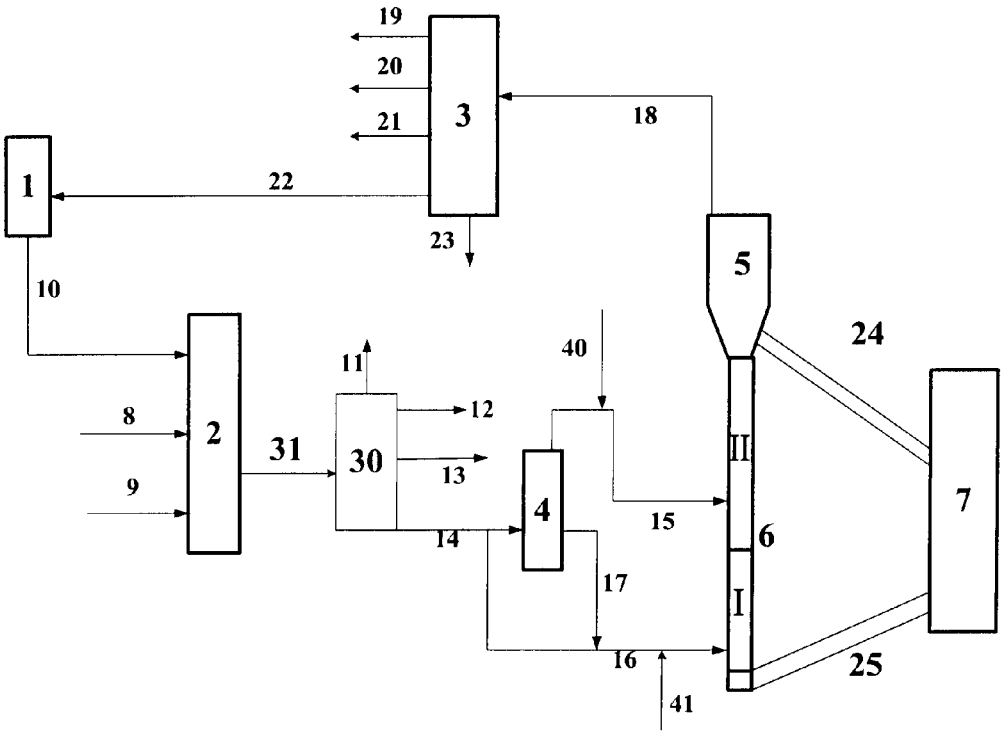
Firgure 1

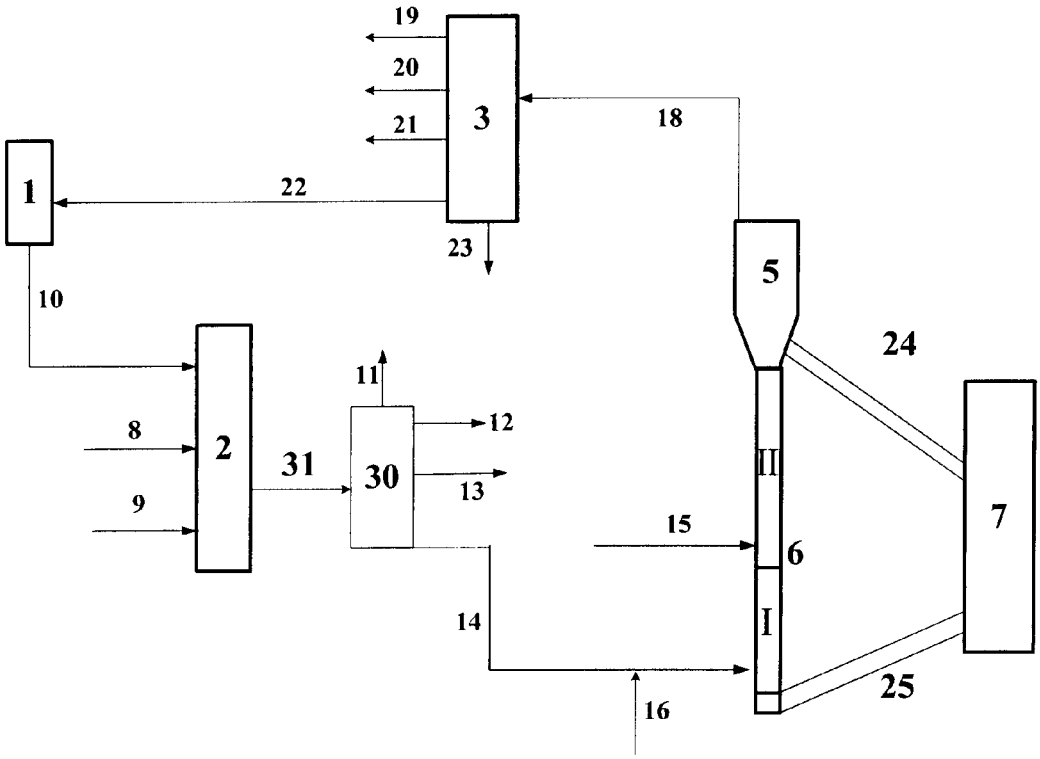
Firgure 2

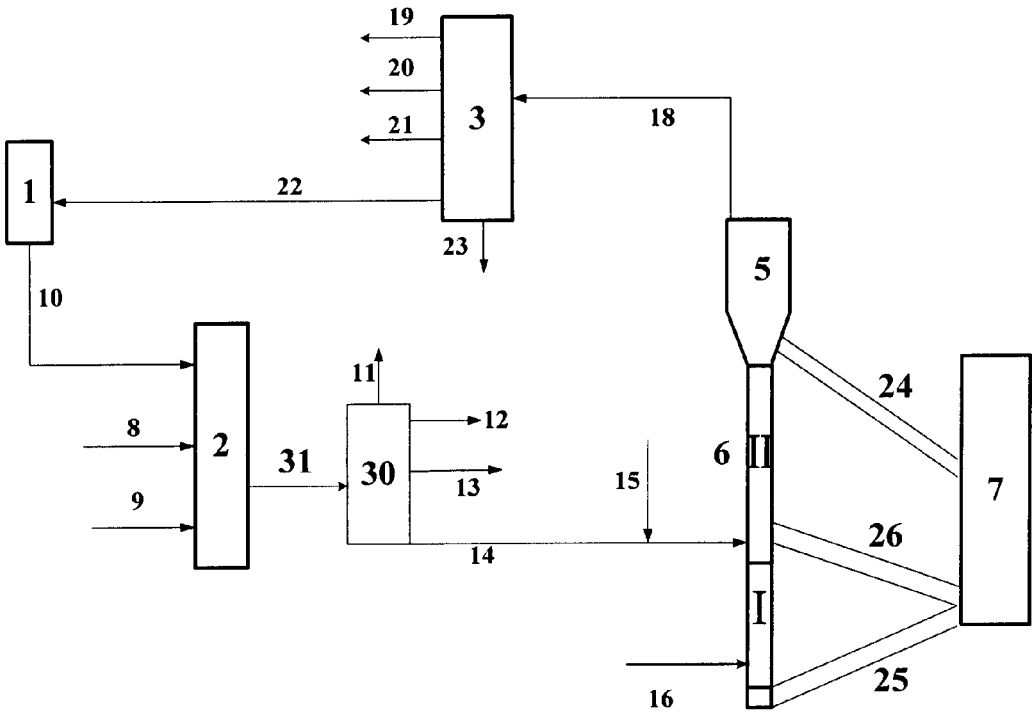
Firgure 3

COMBINED PROCESS OF HYDROTREATING AND CATALYTIC CRACKING OF HYDROCARBON OILS

This is a continuation of application Ser. No. 12/809,516, filed Jun. 18, 2010, which is a National Stage Entry of PCT/CN2008/002033, filed Dec. 19, 2008, and claims priority of Chinese Application No. 200710179984.4, filed Dec. 20, 2007, and Chinese Application No. 200810102302.4, filed Mar. 20, 2008, the contents of all of which are incorporated herein by reference.

FIELD OF THE INVENTION

The present invention relates to a method for hydrocarbon oils conversion employing a combined process of hydrotreating and catalytic cracking.

BACKGROUND OF THE INVENTION

It is a worldwide trend that crude oil becomes heavier and inferior at the present time, however the need for heavy fuel oils decreases gradually whereas the need for light oils increases considerably. Therefore, many oil refining enterprises seek for the maximum conversion of residual oils into products such as automobile gasoline, diesel oil, and liquefied petroleum gas. An efficient way to achieve the above goal is hydrotreating of inferior heavy oil or residual oil, which significantly reduces the amount of impurities such as sulphur, nitrogen and metals, and also the value of carbon residue, thereby satisfying the requirement of raw materials for the normal process in a catalytic cracker.

U.S. Pat. No. 4,713,221 discloses a process based on a combination of normal hydrotreating and catalytic cracking of residual oil. In the process, catalytic cracker (including gas oil catalytic cracker and heavy oil catalytic cracker) heavy cycle oil (HCO) is recycled to residual oil hydrotreating unit and mixed with residual oil, and then is fed to the catalytic cracker (mainly gas oil catalytic cracker) for further process after hydrotreating. Such technical improvement changes products' distribution greatly compared with the normal operation mode wherein catalytic cracker is charged with hydrogenated residual oil as raw materials and HCO itself is recycled to the catalytic cracker. With regard to the example given in this patent wherein the new combination process is utilized with main operation parameters essentially similar, total conversion of catalytic cracker increases by 3 vol. %, mass yield of liquefied petroleum gas increases by 25.7%, mass yield of gasoline increases by 1.07%, mass yield of diesel oil decreases by 3.97%, mass yield of heavy cycle oil decreases by 15.61%, and mass yield of coke decreases by 5.56%.

CN1382776A discloses a combination process for hydrotreating of residual oil and catalytic cracking of heavy oil, in which heavy cycle oil produced in a catalytic cracker and clarified oil from oil slurry are mixed together as part of the feedstock for residual oil equipment, and the hydrogenated stream is recycled with other feedstock to catalytic cracker. Such a process can increase the yields of gasoline and diesel oil from the catalytic cracker.

CN1422327A discloses a process for increasing the yields of small molecule olefins and gasoline, wherein HCO produced in catalytic cracking equipment is hydrogenated or admixed with naphtha, then is introduced into an external, independent catalytic cracking equipment. It is proposed in the claimed process that re-cracking a cycle oil in an external second riser catalytic cracking reactor can suppress the undesirable reaction of hydrogen transfer which would occur if the cycle oil were re-cracked in a single riser reactor with other feedstock. It is beneficial to further increase the yield of light olefins. Based on the above patent, the Chinese patent CN1423689A also discloses that the catalytic cracking catalyst of meso-porous molecular sieve having ZSM-5 structure employed in an external, independent second catalytic cracking reactor may further increase the yield of light olefins. Based on the Chinese patent CN1422327A, the Chinese patent CN1425055A discloses a process for increasing the yield of light olefins by employing a composition containing different hydrogenating catalysts in a hydrogenating reactor and employing a composition containing catalytic cracking catalysts of molecular sieves with different crystal cell sizes in an external, independent second catalytic cracking reactor.

CN1262306A disclosed a combination process for hydrotreating and catalytic cracking of residual oil, which includes: introducing residual oil and clarified oil into residual oil hydrotreating equipment; hydrotreating reaction in the presence of hydrogen and hydrotreating catalyst; charging catalytic cracking equipment with the hydrogenated residual oil; conducting the cracking reaction in the presence of cracking catalyst; recycling the heavy cycle oil into the catalytic cracking equipment; separating the resulting oil slurry from the reaction via separator to obtain clarified oil; and recycling the clarified oil to hydrotreating equipment.

The yield of the products such as automobile gasoline, diesel oil and liquefied petroleum gas can be further increased by hydrotreating of catalytically cracked product heavy oils including heavy cycle oil, clarified oil or all catalytically cracked product heavy oil followed by recycling them into catalytic cracker for reprocessing. But the disadvantages in the prior art lie in the poor adjustability of products' distribution and the poor selectivity of gasoline or diesel oil in products' distribution.

SUMMARY OF THE INVENTION

The object of the present invention is to provide an improved combined method of hydrotreating and catalytic cracking of hydrocarbon oil to address the poor adjustability of products' distribution and the poor selectivity of gasoline or diesel oil in products' distribution in the prior art.

The present invention provides an improved combined method of hydrotreating and catalytic cracking of hydrocarbon oil, including:

contacting residual oil, catalytic cracking cycle oil, and optional distillate oil with a hydrotreating catalyst under hydrotreating conditions in the presence of hydrogen gas followed by separation of the reaction products to obtain gas, hydrogenated naphtha, hydrogenated diesel oil, and hydrogenated tail oil;

contacting the hydrogenated tail oil and/or normal catalytic cracking feedstock oil with a catalytic cracking catalyst under catalytic cracking conditions followed by separation of the reaction products to obtain dry gas, liquefied petroleum gas, catalytically cracked gasoline, catalytically cracked diesel oil, and catalytic cracking cycle oil.

Wherein the contact reaction with the cracking catalyst is carried out in a reactor having at least two reaction zones I and II disposed along the flow direction of reactants;

the hydrogenated tail oil and/or normal catalytic cracking feedstock oil are separated into at least two fractions, the light and the heavy fractions of the hydrogenated tail oil or normal catalytic cracking heavy feedstock oil and normal catalytic cracking light feedstock oil, prior to contacting the hydrogenated tail oil and/or normal catalytic cracking feedstock oil with the cracking catalyst.

The contact reaction with the cracking catalyst involves: charging the reaction zone I with one of the light fraction and the heavy fraction of the hydrogenated tail oil, and optionally with unseparated hydrogenated tail oil, normal catalytic cracking feedstock oil and/or normal catalytic cracking heavy feedstock oil, or normal catalytic cracking light feedstock oil; whereas charging the reaction zone II with the other of the light fraction and the heavy fraction of the hydrogenated tail oil, and optionally with unseparated hydrogenated tail oil, normal catalytic cracking feedstock oil and/or normal catalytic cracking heavy feedstock oil, or normal catalytic cracking light feedstock oil.

Alternatively, the contact reaction with the cracking catalyst involves: charging the reaction zone I with one of normal catalytic cracking heavy feedstock oil and normal catalytic cracking light feedstock oil, optionally together with unseparated hydrogenated tail oil, normal catalytic cracking feedstock oil and/or the light fraction or the heavy fraction of the hydrogenated tail oil; whereas charging the reaction zone II with the other of normal catalytic cracking heavy feedstock oil and normal catalytic cracking light feedstock oil, optionally together with unseparated hydrogenated tail oil, normal catalytic cracking feedstock oil and/or the light fraction or the heavy fraction of the hydrogenated tail oil, wherein the hydrogenated tail oil contents in the mixed feedstocks of the light/heavy feedstock oil optionally mixed with the hydrogenated tail oil and/or the light fraction or the heavy fraction of the hydrogenated tail oil separately are not zero at the same time.

In accordance with the process of the present invention, the hydrogenated tail oil refers to the fraction with a boiling range higher than that of the hydrogenated diesel oil, for example, the fraction with a boiling point above 350° C. It is preferred that the said separation provides 10-80%, preferably 20-70%, more preferably 30-60% of the light fraction, based on the total weight of hydrogenated tail oil.

In accordance with the process of the present invention, when the hydrogenated tail oil is mixed with the normal catalytic cracking light feedstock oil, the amount of the hydrogenated tail oil is no more than 50 wt %, preferably no more than 40 wt %; when the hydrogenated tail oil is mixed with the normal catalytic cracking heavy feedstock oil, the amount of the hydrogenated tail oil is no more than 90 wt %, preferably no more than 80 wt %.

Said normal catalytic cracking feedstock oil is well known to those skilled in the art, for example, it may be vacuum gas oil, atmospheric residua, vacuum gas oil blended with the vacuum residua or other hydrocarbon oils after secondary processing such as one or more of coker gas oil, deasphalted oil, furfural extraction raffinates. Said light feedstock oil and said heavy feedstock oil can be obtained by separation via any one or more processes in the prior art. For example, they can be obtained by separation via the atmospheric pressure distillation and/or vacuum distillation.

Normal catalytic cracking heavy feedstock oil is a hydrocarbon oil with a boiling point above 500° C., whereas normal catalytic cracking light feedstock oil is a hydrocarbon oil with a distillation range of 350-500° C.

Said catalytic cracking cycle oil may be one or more of HCO with large cracking catalyst particles being removed, clarified oil with large catalyst particles being removed, or the whole catalytically cracked heavy oil with large catalyst particles and catalytically cracked diesel oil being removed.

The method for separate the tail oil and/or normal catalytic cracking feedstock oil can be any method in the art which may separate the light fraction from the heavy fraction. For example, said method may be distillation, such as vacuum distillation, flash distillation or the combination of one or more of the above methods. In a preferable embodiment, a method for separate the tail oil and/or normal catalytic cracking feedstock oil into light and heavy fractions is vacuum distillation. The separated heavy fraction is a hydrocarbon oil with a boiling point above 500° C., whereas the separated light fraction is a hydrocarbon oil with a distillation range of 350-500° C.

As well known in the art, when the particles of solid impurities contained in the feedstock oil for charging fixed-bed hydrotreating reactor are smaller than 25 μm, they can pass through the bed layer of hydrotreating catalyst for residua without causing pressure drop ("Improvement of Feeding Filter in Residua Hydrogenation Unit", Mu Haitao, Sun Zhenguang, Petroleum Refinery Engineering, Vol. 31 (5), 2001). Therefore, the particle size of the particles of solid impurities contained in the residua is typically controlled to be less than 25 μm during the conventional hydrotreating reaction of residua. However, the present inventors find that the case is different when introducing feedstock oil which contains catalytic cracking cycle oil into the hydrotreating reactor. Research shows that when the feedstock oil introduced into the hydrotreating reactor contains catalytic cracking cycle oil, both the solid content in the catalytic cracking cycle oil and particle size of the solid particles have an impact on the stability of the operation of the hydrotreating reactor. Thus, in one preferred embodiment the content of solid particles in the HCO with large cracking catalyst particles being removed, the clarified oil with large cracking catalyst particles being removed or the whole catalytically cracked heavy oil with cracking catalyst particles being removed is less than 30 wtppm, and the particle size of the solid particles is less than 10 μm; further preferably the content is less than 15 wtppm, and the particle size of the solid particles is less than 5 μm; more preferably the content is less than 5 wtppm, and the particle size of the solid particles is less than 2 μm.

The particle size is measured with Laser Light Scattering Particle Size Analyzer. The particle sizes of said particles have a distribution within a certain range in particle diameters, wherein the particle diameter means that the particle diameters of 90% (volume) of solid particles within said distribution are smaller than the value. The content of solid particles is measured by the weighing method via calcinating, and the method comprises: weighing out a certain weight of catalytic cracking cycle oil sample in a quartz cup; charring the sample (protected by nitrogen) at a temperature below 600° C. in a burning furnace; air ashing; cooling under the protection of nitrogen; weighing out the residual solid particles; and calculating the content of solid particles in catalytic cracking cycle oil; wherein the variance for repeated measure results is no more than 0.02%.

Said method for removing solid particulate impurities from catalytic cracking cycle oil can be any method that can achieve the separation of solid particles from oil in the prior art. For example, it can be filtering, centrifugation, distillation, and flash distillation or the combination of one or more of the above methods. In one preferred embodiment, the method for removing solid particulate impurities from catalytic cracking cycle oil is preferably filtering. For example, in the case of filters for solid-liquid separation, the filtering aperture size of the filter element can be selected to achieve the desired filtering precision for separation, wherein the filter element can be sintered metal powder plate, sintered wire web or made by any method in the art. In order to enhance filtering efficiency, in one more preferred embodiment, the operation temperature is 100~350° C., more preferably 200~320° C. during the filtering.

The residua contacted with hydrotreating catalyst for reaction can be vacuum residua and/or atmospheric residua. The distillate oil contacted with hydrotreating catalyst for reaction is selected from one or more of the coker gas oil, deasphalted oil, vacuum gas oil and solvent extraction raffinates.

In accordance with the method of the present invention, there is no restriction on the mixing ratio of catalytic cracking cycle oil and residua in the feedstock oil for hydrotreating. It depends on the reaction unit capacity and the material source, and generally catalytic cracking cycle oil is preferably 5-40 wt %, further preferably 6-30 wt %, more preferably 8-25 wt % of the total hydrocarbon oil feedstock.

The hydrotreating unit is a conventional residua hydrotreating reactor. The hydrotreating reactor is typically a fixed-bed reactor, alternatively, it can be a moving-bed reactor or a ebullated-bed reactor.

The residua hydrotreating reaction conditions are as follows: a hydrogen pressure of 5-22 MPa, a reaction temperature of 330-450° C., a volume space velocity of 0.1-3 hour-1, a volume ratio of hydrogen to oil of 350-2000 $Nm^3/m^3$.

The hydrotreating catalyst used is a conventional catalyst or a catalyst combination in the art, for example, the hydrotreating catalyst is one or more of catalysts consisting of active metal component selected from metals of Group VIB and/or non-noble metals of Group VIII and the carrier material selected from alumina, silica, and amorphous Si—Al. The metal component is preferably nickel-tungsten, nickel-tungsten-cobalt, nickel-molybdenum or cobalt-molybdenum composition.

Residua processing technology and the catalyst used therein are described in CN1626625A, CN1648215A, CN1400285A, CN1400288A, CN1262306A, CN1382776A, CN1690172A, and CN1782031A, which are incorporated herein by reference.

In the products of residua hydrotreating, the resulting gas can be used as raw materials for preparing hydrogen or refinery gas; hydrogenated naphtha can be used as raw materials for catalytic reforming or steam cracking for producing ethylene; hydrogenated diesel is an ideal blended component for diesel products; the boiling point of the hydrogenated tail oil is above 350° C., all can be used as feedstock of catalytic cracker.

In accordance with the method of the present invention, said catalytic cracker is conventionally used in the art, for example, the catalytic cracker could be heavy oil fluid catalytic cracker (RFCC), or, any one set or more sets of a catalytic cracker (DCC, a combination of a riser and a dense bed reactor), a prolific isoparaffin catalytic cracker (MIP, a serial combination of a riser and a fast bed reactor), and the like. The catalytic crackers of riser reactor and MIP reactor (as described in Chinese Patent 99105903.4) are preferred in the present invention. The reactor in the catalytic cracker is preferably riser reactor, wherein the reactor includes at least two reaction zones I and II upwards along the vertical direction. In a further preferred catalytic cracker, a delivery device for regenerated catalysts is provided between said reaction zone II and cracking catalyst regenerator. The control of the operating severity (including the reaction temperature and catalyst to oil ratio) and further control of the distribution of the final products can be achieved by introducing the high-temperature regenerated catalyst into the reaction zone II through the device or not.

In addition, said reaction pressure used herein usually refers to the gauge one unless it is specially stated otherwise.

In the reaction zone I of said catalytic cracker, reaction temperature is 550-700° C., catalyst to oil ratio is 4-50, reaction time is 0.5 second to 10 seconds, atomized water steam is 2-50 wt % of the feedstock, and reaction pressure is from normal pressure to 300 kPa; preferably the reaction temperature is 560-650° C., the catalyst to oil ratio is 7-20, a reaction time of 1 second to 2 seconds, the atomized water steam is 5-10 wt % of the feedstock, and the reaction pressure is 100-300 kPa.

In the reaction zone II of said catalytic cracker, reaction temperature is 500-600° C., catalyst to oil ratio is 3-50, reaction time is 0.2 second to 8 seconds, atomized water steam is 2-20 wt % of the feedstock, and reaction pressure is from normal pressure to 300 kPa; preferably the reaction temperature is 510-560° C., the catalyst to oil ratio is 5-40, a reaction time of 0.5 second to 1.5 seconds, the atomized water steam is 4-8 wt % of the feedstock, and the reaction pressure is 100-300 kPa.

Said catalytic cracking catalyst can be one catalyst or a combination of catalysts in the prior art. Cracking catalysts available in the prior art generally contain zeolite, inorganic oxides and optional clay, wherein the amounts of each component are: from 5 wt % to 50 wt % of zeolite, from 5 wt % to 95 wt % of inorganic oxides, from 0 wt % to 70 wt % of clay, respectively.

Said zeolite is the active component selected from macroporous zeolite and optional mesoporous zeolite, wherein macroporous zeolite comprises 25 to 100 wt %, preferably 50 to 100 wt % of the active component, and mesoporous zeolite comprises 0 to 75 wt %, preferably 0 to 50 wt % of the active component.

Said macroporous zeolite is selected from Y-zeolite, rare earth Y-zeolite (REY), rare earth hydrogen Y-zeolite (REHY), ultra-stable Y-zeolite (USY), rare earth ultra-stable Y-zeolite (REUSY) and a mixture of one or more of them.

Said mesoporous zeolite is selected from ZSM series zeolite and/or ZRP zeolite, which can also be modified with non-metallic elements such as phosphorus and/or transition metal elements such as iron, cobalt, nickel, and the like. ZSM series zeolite is selected from ZSM-5, ZSM-11, ZSM-12, ZSM-23, ZSM-35, ZSM-38, ZSM-48 and other zeolites with similar structures, or a mixture thereof.

Said inorganic oxide is used as a binder, and may be selected from silicon dioxide ($SiO_2$) and/or aluminum oxide ($Al_2O_3$).

Said clay is used as a matrix, that is, a carrier, and may be selected from kaolin and/or halloysite.

Catalytic cracking processing technology and the catalysts used therein are described in U.S. Pat. No. 6,495,028、CN110116、CN110116C、CN1072032C、CN1814705、CN1814707、CN1854251 and CN1854254, which are incorporated herein by reference.

In accordance with the methods of the present invention, the product oils from hydrotreating reaction or the product oils from catalytic cracking can be separated via distillation to obtain hydrogenated naphtha, hydrogenated diesel oil, hydrogenated tail oil, or the products such as liquefied petroleum gas, catalytically cracked gasoline, catalytically cracked diesel oil, and catalytic cracking cycle oil. Said distillation is well known in the art, generally including one or more operation units of flash distillation, normal distillation and vacuum distillation for the desired separation.

Compared with the prior art, the beneficial effects of the invention are mainly as follows:

(1) The hydrogenated tail oil is separated into the light fraction and the heavy fraction which are introduced into different reaction zones in the catalytic cracker, and cracking reaction of hydrogenated hydrocarbon oils can be controlled by adjustment of operation conditions of the different reaction zones, thereby obtaining the desired distribution of products.

For example, said heavy fraction alone or together with other foreign heavy hydrocarbon oil are introduced into catalytic cracking reaction zone I with a larger ratio of catalyst to oil (such as 7-16) and a higher contact temperature for catalyst and oil (for example, 580-650° C.) employed to enhance the conversion depth of heavy oil cracking, thereby improving the yield of light oil in the catalytically cracked products. Said light fraction alone or together with other foreign light hydrocarbon oil are introduced into catalytic cracking reaction zone II, then mixed with the stream rising from the reaction zone I, and further catalytically cracked by cracking catalysts therein. Since the cracking catalyst contacts and reacts with heavy distillate first in reaction zone I, a certain amount of coke will be produced on the catalyst to suppress the catalyst's activity. Such suppression will reduce the conversion depth of light distillate cracking, and facilitate the increase in the yield of gasoline and diesel and the decrease in the yield of gas products.

(2) Introduction of the combination of hydrogenated tail oil and other light or heavy oil feedstock into at least two bottom-up reaction zones I and II in the reactor of catalytic cracker can control the cracking reaction of hydrocarbon oil, thereby obtaining the desired distribution of products. For example, when said hydrogenated tail oil and other heavy catalytic cracking feedstock oil are introduced into the catalytic cracking reaction zone I, said hydrogenated tail oil can function as a diluter to heavy oil, and higher aromaticity of hydrogen-modified catalytic cracking cycle oil contained in the hydrogenated tail oil can further strengthen the dissociation of the asphaltenes and the aromatic micelle in heavy hydrocarbons, and thus the efficiency of the contact reaction between residua and catalyst can be significantly improved. Meanwhile, a higher ratio of catalyst to oil (such as 5-12) and a higher contact temperature between catalyst and oil (for example, 580-650° C.) are used, and the reaction retention time is controlled within the range from 1 to 1.5 seconds, and thereby the conversion depth of heavy oil cracking is enhanced which is beneficial to improving the yield of light oil in the catalytically cracked products. Subsequently light hydrocarbon oil is introduced into catalytic cracking reaction zone II, then mixed with the stream rising from the reaction zone I, and further catalytically cracked by cracking catalysts therein. It is preferred that the operation conditions of the reaction zone II are as follows: a reaction temperature of 510-540° C., a ratio of catalyst to oil of 9-40, a reaction retention time of 1.0-1.8 seconds, respectively. Since the cracking catalyst contacts and reacts with heavy distillate first in reaction zone I, a certain amount of coke will be produced on the catalyst to passivate the catalyst. Such passivation will reduce the conversion depth of light distillate cracking, and facilitate the increase in the yield of gasoline and diesel and the decrease in the yield of gas products.

(3) A delivery device for regenerated catalyst is equipped between the reactor's reaction zone II and cracking catalyst regenerator, and thus a stream of fresh high-temperature regenerated catalyst can be introduced into the reactor zone II to adjust their reaction severity, at the same time relative moderate conditions are used for the reactor zone I, and thereby the yield of dry gas is effectively reduced and the yield of high-value products is effectively increased.

For example, said heavy oil alone is introduced into catalytic cracking reaction zone I, and a higher ratio of catalyst to oil (such as 10-18) and a moderate contact temperature between catalyst and oil (for example, 550-600° C.) are used, and the reaction retention time is controlled as 0.9 second to 1.3 seconds, and thereby the conversion depth of heavy oil cracking is enhanced and at the same time the yield of dry gas is reduced; Subsequently the mixture of said hydrogenated tail oil and other foreign light hydrocarbon oils is introduced into catalytic cracking reaction zone II, then mixed with the stream rising from the reaction zone I, and further catalytically cracked by cracking catalysts therein. Since at first the cracking catalyst contacts and reacts with heavy distillate in reaction zone I, a certain amount of coke will be produced on the catalyst to passivate the catalyst. However fresh regenerated catalyst is introduced from the regenerator into the reactor zone II, thus the conversion capacity of catalysts in the reactor zone II is enhanced. It is preferred that the operation conditions of the reaction zone II are as follows: reaction temperature 520-580° C., the ratio of catalyst to oil 9-18, the reaction retention time 1.3-2.0 seconds, respectively. As a result, the conversion of heavy oil and the yield of high-value products such as gasoline and diesel oil are enhanced, whereas the yield of dry gas is decreased.

The method of the present invention is especially suitable for the hydrocarbon oil conversion for more light oil products such as gasoline and diesel oil.

BRIEF DESCRIPTION OF THE DRAWINGS

FIG. 1 is a schematic illustration of an combined process of hydrotreating and catalytic cracking of hydrocarbon oils of the present invention.

FIG. 2 is a schematic illustration of an combined process of hydrotreating and catalytic cracking of hydrocarbon oils of the present invention.

FIG. 3 is a schematic illustration of a more flexible combined process of hydrotreating and catalytic cracking of hydrocarbon oils of the present invention.

MODE OF CARRYING OUT THE INVENTION

In accordance with one embodiment of the present invention, said contact reaction with catalytic cracking catalysts is carried out by charging the reaction zone I with the heavy fraction of hydrogenated tail oil and optional unseparated hydrogenated tail oil, whereas charging the reaction zone II with the light fraction of hydrogenated tail oil. The amount of said light fraction of the hydrogenated tail oil is 10-70% by weight, based on the total weight of hydrogenated tail oil to be separated; it is preferred that said separation provides 20-55% by weight of the light fraction, based on the total weight of hydrogenated tail oil; and it is more preferred that said separation provides 25-35% by weight of the light fraction, based on the total weight of hydrogenated tail oil.

The reaction conditions in the reaction zone I are as follows: reaction temperature is 550-700° C., catalyst to oil ratio is 5-20, reaction time is 0.5-10 seconds, atomized water steam is 2-50% by weight of the feedstock, and reaction pressure is from normal pressure to 300 kPa. It is preferred that the reaction conditions in the reaction zone I are as follows: reaction temperature is 560-650° C., catalyst to oil ratio is 7-16, reaction time is 1-2 seconds, atomized water steam is 5-10% by weight of the feedstock, and reaction pressure is 100-300 kPa.

The reaction conditions in the reaction zone II are as follows: reaction temperature is 500-600° C., catalyst to oil ratio is 7-20, reaction time is 0.2-8 seconds, atomized water steam is 2-20% by weight of the feedstock, and reaction pressure is from normal pressure to 300 kPa. It is preferred that the reaction conditions in the reaction zone II are as follows: reaction temperature is 510-560° C., catalyst to oil ratio is 10-18, reaction time is 0.5-1.5 seconds, atomized water steam is 4-8% by weight of the feedstock, and reaction pressure is 100-300 kPa.

In accordance with one embodiment of the present invention, said contact reaction with catalytic cracking catalysts is carried out by charging the reaction zone I with the light fraction of hydrogenated tail oil, whereas charging the reaction zone II with the heavy fraction of hydrogenated tail oil and optional unseparated hydrogenated tail oil. The amount of said light fraction of the hydrogenated tail oil is 10-50% by weight, based on the total weight of hydrogenated tail oil to be separated; it is preferred that said separation provides 20-45% by weight of the light fraction, based on the total weight of hydrogenated tail oil; and it is more preferred that said separation provides 25-35% by weight of the light fraction, based on the total weight of hydrogenated tail oil.

In this embodiment, the reaction conditions in the reaction zone I are as follows: reaction temperature is 550-700° C., catalyst to oil ratio is 5-20, reaction time is 0.5-10 seconds, atomized water steam is 2-50% by weight of the feedstock, and reaction pressure is from normal pressure to 300 kPa. Preferably the reaction temperature in the reaction zone I is 560-650° C., catalyst to oil ratio is 7-16, reaction time is 1-1.5 seconds, atomized water steam is 5-10% by weight of the feedstock, and the reaction pressure is 100-300 kPa.

In this embodiment, the reaction conditions in the reaction zone II are as follows: reaction temperature is 500-600° C., catalyst to oil ratio is 7-20, reaction time is 0.2-8 seconds, atomized water steam is 2-20% by weight of the feedstock, and reaction pressure is from normal pressure to 300 kPa. Preferably reaction temperature in the reaction zone II is 520-560° C., catalyst to oil ratio is 10-18, reaction time is 1-2 seconds, atomized water steam is 4-8% by weight of the feedstock, and reaction pressure is 100-300 kPa. The regenerated catalysts may be introduced into said reaction zone II.

In accordance with one embodiment of the present invention, said contact reaction with catalytic cracking catalysts is carried out by charging the reaction zone I with the heavy fraction of hydrogenated tail oil, optional unseparated hydrogenated tail oil and/or normal catalytic cracking feedstock oil, whereas charging the reaction zone II with the light fraction of hydrogenated tail oil. The amount of said light fraction of the hydrogenated tail oil is 10-50% by weight, based on the total weight of hydrogenated tail oil to be separated; it is preferred that said separation provides 20-45% by weight of the light fraction, based on the total weight of hydrogenated tail oil; and it is more preferred that said separation provides 25-35% by weight of the light fraction, based on the total weight of hydrogenated tail oil.

In this embodiment, the reaction conditions in the reaction zone I are as follows: reaction temperature is 550-700° C., catalyst to oil ratio is 5-20, reaction time is 0.5-10 seconds, atomized water steam is 2-50% by weight of the feedstock, and reaction pressure is from normal pressure to 300 kPa. It is preferred that the reaction conditions in the reaction zone I are as follows: reaction temperature is 560-650° C., catalyst to oil ratio is 7-16, reaction time is 1-2 seconds, atomized water steam is 5-10% by weight of the feedstock, and reaction pressure is 100-300 kPa.

In this embodiment, the reaction conditions in the reaction zone II are as follows: reaction temperature is 500-600° C., catalyst to oil ratio is 3-20, reaction time is 0.2-8 seconds, atomized water steam constitutes 2-20% by weight of the feedstock, and reaction pressure is from normal pressure to 300 kPa. It is preferred that the reaction conditions in the reaction zone II are as follows: reaction temperature is 510-560° C., catalyst to oil ratio is 6-14, reaction time is 0.5-1.5 seconds, atomized water steam is 4-8% by weight of the feedstock, and reaction pressure is 100-300 kPa.

In accordance with one embodiment of the present invention, said contact reaction with catalytic cracking catalysts is carried out by charging the reaction zone I with the light fraction of hydrogenated tail oil and optional normal catalytic cracking feedstock oil, whereas charging the reaction zone II with the heavy fraction of hydrogenated tail oil and optional unseparated hydrogenated tail oil. The amount of said light fraction of the hydrogenated tail oil is 10-50% by weight, based on the total weight of hydrogenated tail oil to be separated; it is preferred that said separation provides 20-45% by weight of the light fraction, based on the total weight of hydrogenated tail oil; and it is more preferred that said separation provides 25-35% by weight of the light fraction, based on the total weight of hydrogenated tail oil.

In this embodiment, the reaction conditions in the reaction zone I are as follows: reaction temperature is 550-700° C., catalyst to oil ratio is 5-20, reaction time is 0.5-10 seconds, atomized water steam is 2-50% by weight of the feedstock, and reaction pressure is from normal pressure to 300 kPa. Preferably the reaction temperature in the reaction zone I is 560-650° C., catalyst to oil ratio is 7-16, reaction time is 1-1.5 seconds, atomized water steam is 5-10% by weight of the feedstock, and reaction pressure is 100-300 kPa.

In this embodiment, the reaction conditions in the reaction zone II are as follows: reaction temperature is 500-600° C., catalyst to oil ratio is 7-20, reaction time is 0.2-8 seconds, atomized water steam is 2-20% by weight of the feedstock, and reaction pressure is from normal pressure to 300 kPa. Preferably reaction temperature in the reaction zone II is 520-560° C., catalyst to oil ratio is 10-18, reaction time is 1-2 seconds, atomized water steam is 4-8% by weight of the feedstock, and reaction pressure is 100-300 kPa. The regenerated catalysts may be introduced into said reaction zone II.

In accordance with one embodiment of the present invention, said contact reaction with catalytic cracking catalysts is carried out by charging the reaction zone I with the heavy fraction of hydrogenated tail oil, normal catalytic cracking heavy feedstock oil and optional unseparated hydrogenated tail oil, whereas charging the reaction zone II with the light fraction of hydrogenated tail oil and normal catalytic cracking light feedstock oil. The amount of said light fraction of the hydrogenated tail oil is 10-50% by weight, based on the total weight of hydrogenated tail oil to be separated; it is preferred that said separation provides 20-45% by weight of the light fraction, based on the total weight of hydrogenated tail oil; and it is more preferred that said separation provides 25-35% by weight of the light fraction, based on the total weight of hydrogenated tail oil.

In this embodiment, the reaction conditions in the reaction zone I are as follows: reaction temperature is 550-700° C., catalyst to oil ratio is 4-20, reaction time is 0.5-10 seconds, atomized water steam is 2-50% by weight of the feedstock, and reaction pressure is from normal pressure to 300 kPa. Preferably the reaction conditions in the reaction zone I are as follows: reaction temperature is 560-650° C., catalyst to oil ratio is 5-16, reaction time is 1-2 seconds, atomized water steam is 5-10% by weight of the feedstock, and reaction pressure is 100-300 kPa.

In this embodiment, the reaction conditions in the reaction zone II are as follows: reaction temperature is 500-600° C., catalyst to oil ratio is 3-20, reaction time is 0.2-8 seconds, atomized water steam is 2-20% by weight of the feedstock, and reaction pressure is from normal pressure to 300 kPa. Preferably the reaction conditions in the reaction zone II are as follows: reaction temperature is 510-560° C., catalyst to oil ratio is 6-14, reaction time is 0.5-1.5 seconds, atomized water steam is 4-8% by weight of the feedstock, and reaction pressure is 100-300 kPa.

In accordance with one embodiment of the present invention, said contact reaction with catalytic cracking catalysts is carried out by charging the reaction zone I with the light fraction of hydrogenated tail oil, normal catalytic cracking heavy feedstock oil and optional unseparated hydrogenated tail oil, whereas charging the reaction zone II with the heavy fraction of hydrogenated tail oil and normal catalytic cracking light feedstock oil. The amount of said light fraction of the hydrogenated tail oil is 10-50% by weight, based on the total weight of hydrogenated tail oil to be separated; it is preferred that said separation provides 20-45% by weight of the light fraction, based on the total weight of hydrogenated tail oil; and it is more preferred that said separation provides 25-35% by weight of the light fraction, based on the total weight of hydrogenated tail oil. The proportion of the light fraction of hydrogenated tail oil is at least larger than 0, with no restriction on maximum proportion.

In this embodiment, the reaction conditions in the reaction zone I are as follows: reaction temperature is 550-700° C., catalyst to oil ratio is 5-20, reaction time is 0.5-10 seconds, atomized water steam is 2-50% by weight of the feedstock, and reaction pressure is from normal pressure to 300 kPa. Preferably the reaction temperature in the reaction zone I is 560-650° C., catalyst to oil ratio is 7-16, reaction time is 1-1.5 seconds, atomized water steam is 5-10% by weight of the feedstock, and reaction pressure is 100-300 kPa.

In this embodiment, the reaction conditions in the reaction zone II are as follows: reaction temperature is 500-600° C., catalyst to oil ratio is 7-50, reaction time is 0.2-8 seconds, atomized water steam is 2-20% by weight of the feedstock, and reaction pressure is from normal pressure to 300 kPa. Preferably reaction temperature in the reaction zone II is 520-560° C., catalyst to oil ratio is 8-40, reaction time is 1-2 seconds, atomized water steam is 4-8% by weight of the feedstock, and reaction pressure is 100-300 kPa. Regenerated catalysts may be introduced into said reaction zone II.

In accordance with one embodiment of the present invention, said contact reaction with catalytic cracking catalysts is carried out by charging the reaction zone I with normal catalytic cracking heavy feedstock oil and unseparated hydrogenated tail oil, whereas charging the reaction zone II with said normal catalytic cracking light feedstock oil. The amount of said hydrogenated tail oil in mixed feedstock of normal catalytic cracking heavy feedstock oil and unseparated hydrogenated tail oil is no more than 90% by weight, preferably no more than 80% by weight.

In this embodiment, the reaction conditions in the reaction zone I are as follows: reaction temperature is 550-700° C., catalyst to oil ratio is 4-20, reaction time is 0.5-10 seconds, atomized water steam is 2-50% by weight of the feedstock, and reaction pressure is from normal pressure to 300 kPa. Preferably the reaction conditions in the reaction zone I are as follows: reaction temperature is 560-650° C., catalyst to oil ratio is 5-16, reaction time is 1-2 seconds, atomized water steam is 5-10% by weight of the feedstock, and reaction pressure is 100-300 kPa.

In this embodiment, the reaction conditions in the reaction zone II are as follows: reaction temperature is 500-600° C., catalyst to oil ratio is 7-50, reaction time is 0.2-8 seconds, atomized water steam is 2-20% by weight of the feedstock, and reaction pressure is from normal pressure to 300 kPa. Preferably the reaction conditions in the reaction zone II are as follows: reaction temperature is 510-560° C., catalyst to oil ratio is 8-40, reaction time is 0.5-1.5 seconds, atomized water steam is 4-8% by weight of the feedstock, and reaction pressure is 100-300 kPa.

In accordance with one embodiment of the present invention, said contact reaction with catalytic cracking catalysts is carried out by charging the reaction zone I with said normal catalytic cracking heavy feedstock oil and optional normal catalytic cracking feedstock oil, whereas charging the reaction zone II with said normal catalytic cracking light feedstock oil and unseparated hydrogenated tail oil. The amount of said hydrogenated tail oil in mixed feedstock of said normal catalytic cracking light feedstock oil and unseparated hydrogenated tail oil is no more than 50% by weight, preferably no more than 40% by weight.

In this embodiment, the reaction conditions in the reaction zone I are as follows: reaction temperature is 550-700° C., catalyst to oil ratio is 4-20, reaction time is 0.5-10 seconds, atomized water steam is 2-50% by weight of the feedstock, and reaction pressure is from normal pressure to 300 kPa. Preferably reaction temperature in the reaction zone I is 560-650° C., catalyst to oil ratio is 5-16, reaction time is 1-1.5 seconds, atomized water steam is 5-10% by weight of the feedstock, and reaction pressure is 100-300 kPa.

In this embodiment, the reaction conditions in the reaction zone II are as follows: reaction temperature is 500-600° C., catalyst to oil ratio is 7-50, reaction time is 0.2-8 seconds, atomized water steam is 2-20% by weight of the feedstock, and reaction pressure is from normal pressure to 300 kPa. Preferably reaction temperature in the reaction zone II is 520-560° C., catalyst to oil ratio is 8-40, reaction time is 1-2 seconds, atomized water steam is 4-8% by weight of the feedstock, and reaction pressure is 100-300 kPa. The regenerated catalysts may be introduced into said reaction zone II.

In accordance with the scheme showed in FIG. 1, hydrogen introduced via 8, residual oil introduced via 9 and catalytic cracking cycle oil 10 with solid particles being removed are fed into hydrotreating unit 2 so as to be contacted with hydrotreating catalysts; the reaction products are introduced via line 31 into product separation equipment 30 for separation; the product gas via 11, hydrogenated naphtha via 12 and hydrogenated diesel oil via 13 are drawn out of the equipment, respectively. Hydrogenated tail oil is partly or fully introduced into hydrogenated tail oil fractionating tower 4 via 14 to be separated into light and heavy fractions. Said separation provides 10-80% by weight, preferably 20-70% by weight, more preferably 30-60% by weight of the light fraction, based on the total weight of hydrogenated tail oil. Wherein said heavy fraction, alone or mixed with other foreign cracking feedstock oil 41 and/or hydrogenated tail oil which is not introduced into hydrogenated tail oil fractionating tower 4 for separation, is introduced via 16 into catalytic cracking reaction zone I for reaction; and said light fraction, alone or mixed with other cracking feedstock oil 40 and/or hydrogenated tail oil which is not introduced into hydrogenated tail oil fractionating tower 4 for separation, is introduced via 15 into catalytic cracking reaction zone II for reaction. Catalytic cracking reaction products are isolated from catalysts in catalytic cracking reaction settler 5, and are introduced via 18 into catalytic cracking product separation equipment 3 for separation. The product gas via 19, catalytic cracking gasoline via 20 and catalytic cracking diesel oil via 21 are removed from the equipment. The catalytic cracking cycle oil is partly or fully introduced via 22 into catalytic cracking cycle oil filter 1 for filtration. After such filtration, the solid particles in the catalytic cracking cycle oil to be introduced via 10 into hydrotreating reaction equipment 2 have a content of less than 30 ppm by weight, and a particle size of less than 10 μm, preferably, a content of less than 15 ppm by weight, and a particle size of less than 5 μm. While one part of catalytic cracking cycle oil is filtrated and introduced into hydrotreating equipment for hydrotreating and subsequent reaction, the other part is drawn out via 23 and may be used as raw materials for producing fuel oils, needle-shaped refinery coke and carbon black. The catalysts separated from the cracking products in catalytic cracking reaction settler 5 are introduced via 24 into catalyst regenerator 7 for regeneration, and the regenerated catalysts can be recycled via 25 into catalytic cracking reactor 6 for reaction.

In accordance with the scheme showed in FIG. 1, it is easy to control products' distribution of cracking reaction by: varying the amount of catalytic cracking cycle oil introduced into the hydrotreating equipment; adjusting the ratio of the light fraction to the heavy fraction obtained from vacuum distillation of hydrogenated tail oil; varying the positions at which the light fraction via 15 and the heavy fraction via 16 are introduced into the catalytic cracking reactor; varying operation conditions and the like, so as to realize the object of producing gasoline oil and diesel oil in high yield with ensuring sufficient conversion of cracking raw materials.

In accordance with the scheme showed in FIG. 2, hydrogen introduced via 8, residual oil and optional fractional oil introduced via 9, and catalytic cracking cycle oil with solid particles removed introduced via 10 are fed into hydrotreating unit equipment 2 together to contact hydrotreating catalysts for reaction; the reaction products are introduced via 31 into product separation equipment 30 for separation; the product gas via 11, hydrogenated naphtha via 12 and hydrogenated diesel oil via 13 are drawn out of the equipment, respectively. Hydrogenated tail oil via 14 and heavy feedstock oil introduced via 16 are fed into the catalytic cracking reaction zone I to contact catalytic cracking catalysts for reaction, and light cracking feedstock oil 15 is introduced into the catalytic cracking reaction zone II to contact catalytic cracking catalysts for reaction. Catalytic cracking reaction products are isolated from catalysts in catalytic cracking reaction settler 5, and are introduced via 18 into catalytic cracking product separation equipment 3 for separation. The product gas via 19, catalytic cracking gasoline via 20 and catalytic cracking diesel oil via 21 are drawn out of the equipment. The catalytic cracking cycle oil (including one or more of heavy cycle oil, clarified oil and all the remaining catalytic cracking heavy oil with catalytic cracking diesel oil separated) is partly or fully introduced via 22 into catalytic cracking cycle oil/solid particles separator 1 to remove the solid particles therein. Through such removal, the solid particles in the catalytic cracking cycle oil introduced via 10 into hydrotreating reaction equipment 2 have a content of less than 30 ppm by weight, and a particle size of less than 10 μm, preferably, a content of less than 15 ppm by weight, and a particle size of less than 5 μm. While one part of catalytic cracking cycle oil is filtrated and introduced into hydrotreating equipment for hydrotreating and subsequent reaction, the other part is drawn out via 23 and may be used as raw materials for producing fuel oils, needle-shaped refinery coke and carbon black. The catalysts separated from the cracked products in catalytic cracking reaction settler 5 are introduced via 24 into catalyst regenerator 7 for regeneration, and the regenerated catalysts are recycled via 25 into catalytic reactor 6 for reaction.

In addition to the feed manner illustrated in FIG. 2 wherein hydrogenated tail oil via 14 and the heavy feedstock oil introduced via 16 are fed into the catalytic cracking reaction zone I together to contact with catalytic cracking catalysts for reaction, there are also two optional manners by which hydrogenated tail oil via 14 can be mixed with conventional catalytic cracking feedstock oil and then be introduced into catalytic cracking reaction zones to contact with catalytic cracking catalysts for reaction: 1) hydrogenated tail oil together with light cracking feedstock oil introduced via 15 are fed into the catalytic cracking reaction zone II to contact with catalytic cracking catalysts for reaction; 2) hydrogenated tail oil may be separated into two streams, the light fraction and the heavy fraction, wherein one of the heavy fraction and the light fraction of hydrogenated tail oil is fed into the catalytic cracking reaction zone II together with light cracking feedstock oil introduced via 15 to contact with catalytic cracking catalysts for reaction, whereas the other of the heavy fraction and the light fraction of hydrogenated tail oil are fed into the catalytic cracking reaction zone I together with heavy feedstock oil introduced via 16 to contact with catalytic cracking catalysts for reaction.

FIG. 3 is a schematic illustration of a combination process for hydrotreating and catalytic cracking of hydrocarbon oils according to the present invention.

The differences between FIG. 3 and FIG. 2 are as follows: in FIG. 3, high temperature regenerated catalyst are introduced via an additional 26 from a regenerator into the reaction zone II, and hydrogenated tail oil via 14 together with light feedstock oil introduced via 15 are fed into the catalytic cracking reaction zone II to contact with catalysts for reaction, while heavy feedstock oil is introduced via 16 into the catalytic cracking reaction zone I to contact with catalysts for reaction. Wherein, the high temperature regenerated catalyst are introduced via 26 into the reaction zone II at such a position that the residence time of hydrocarbons in the reaction zone II is not less than 0.2 second, preferably not less than 1 second. Reaction temperature, operation ratio of catalyst to oil, reaction time and so on in the reaction zone II can be regulated and modified flexibly by introducing high temperature regenerated catalysts from a regenerator into the reaction zone II of the reactor 6, thereby the cracking products' distribution can be better regulated and modified to meet various demands.

In addition to the feed manner given by the scheme showed in FIG. 3 wherein hydrogenated tail oil via 14 and the light feedstock oil introduced via 15 are fed into the catalytic cracking reaction zone II to contact with catalytic cracking catalysts for reaction, there are also two optional manners by which hydrogenated tail oil via 14 can be mixed with conventional catalytic cracking feedstock oil and then introduced into the catalytic cracking reaction zones to contact with catalytic cracking catalysts for reaction: 1) hydrogenated tail oil together with heavy cracking feedstock oil introduced via 16 are fed into the catalytic cracking reaction zone I to contact with catalytic cracking catalysts for reaction; 2) hydrogenated tail oil is separated into two streams, wherein one of the heavy fraction and the light fraction of hydrogenated tail oil feeds together with light cracking feedstock oil introduced via 15 into the catalytic cracking reaction zone II to contact with catalytic cracking catalysts for reaction, whereas the other of the heavy fraction and the light fraction of hydrogenated tail oil feeds together with heavy feedstock oil introduced via 16 into the catalytic cracking reaction zone I to contact with catalytic cracking catalysts for reaction.

While embodiments of the present disclosure are described in connection with the above embodiments and the corresponding text and figures, there is no intent to limit the disclosure to the embodiments in these descriptions. On the contrary, the intent is to cover all alternatives, modifications, and equivalents included within the spirit and scope of embodiments of the present disclosure.

The present invention will be further illustrated with reference to the following examples, but not limited thereby.

Feedstock oil is processed in accordance with the scheme showed in FIG. 1, wherein raw materials in hydrotreating equipment are feedstock oil A and B, respectively, obtained by mixing residual oil and catalytic cracking cycle oil (i.e., diluting oil) in different ratios, and the properties of feedstock oil A and B are shown in Table 1.

The hydrotreating reaction is carried out in a reaction equipment comprising three fixed beds. Wherein, the first reactor, i.e. up-flow reactor (UFR), is charged from bottom to up with catalysts RUF-1 and RUF-2 in a ratio of 1:2, so that the catalysts in the first reactor occupy about 44% of total loading volume of catalysts of the hydrotreating equipment. The second and third reactors are down-flow fixed bed reactors. The second reactor is charged with demetallization catalysts RDM-2, so that the catalysts in the second reactor occupy about 12% of total packing volume of catalysts of the hydrotreating equipment. The third reactor is charged with desulfurization catalysts RMS-1, so that the catalysts in the third reactor occupy about 44% of total packing volume of catalysts of the hydrotreating equipment. The above-mentioned catalysts are available from Changlin Catalyst plant of SINOPEC, China.

Said catalytic cracking reaction is carried out in a riser reactor with two reaction zones, and said catalytic cracking catalyst is RMS-8 (available from Qilu Catalyst plant of SINOPEC, China).

Solid particles in catalytic cracking cycle oil (which is a mixture of catalytic cracking heavy cycle oil and clarified oil) are removed through a filtration equipment, wherein the filtering aperture size of the filter element used in the filtration equipment is 0.1 to 5 μm, and filtration temperature is 250° C. The particle size and the content of solid particles in the catalytic cracking cycle oil after filtration are shown in Table 1.

Example 1

This example illustrates the effect of the process provided by the present invention.

In this example, feedstock oil A is used as the feedstock oil to introduce into hydrotreating reaction equipment, and the reaction conditions of hydrotreating reaction and products' distribution of oils produced by hydrotreating are shown in Table 2. Light oil fraction (55% by weight, based on the total weight of hydrogenated tail oil) and heavy oil fraction (i.e. the bottom heavy oil, 45% by weight, based on the total weight of hydrogenated tail oil) of hydrogenated tail oil are produced by vacuum distillation, respectively, and the properties of these two fractions are shown in Table 3. Said heavy oil fraction of hydrogenated tail oil is introduced into catalytic cracking reaction zone I, whereas said light oil fraction of hydrogenated tail oil is introduced into catalytic cracking reaction zone II. They contact catalytic cracking catalysts for reaction respectively. The catalytic cracking reaction conditions and the results are shown in Table 4.

Comparative Example 1

The feedstock oil to be processed, the catalyst to be used and the operation conditions of this comparative example are same as those of Example 1, except that hydrogenated tail oil is not separated and is introduced directly into catalytic cracking reaction zone I to be contacted with catalytic cracking catalysts for reaction in this comparative example. The properties of hydrogenated tail oil are shown in Table 3, and the catalytic cracking conditions and the results are shown in Table 4.

Example 2

This example illustrates the effect of the process provided by the present invention.

In this example, feedstock oil B is used as the feedstock oil to introduce into hydrotreating reaction equipment, and the reaction conditions of hydrotreating reaction and products' distribution of oils produced by hydrotreating are shown in Table 2. Light oil fraction (39% by weight, based on the total weight of hydrogenated tail oil) and heavy oil fraction (i.e. the bottom heavy oil, 61% by weight, based on the total weight of hydrogenated tail oil) of hydrogenated tail oil are produced by vacuum distillation, respectively, and the properties of these two fractions are shown in Table 3. Said heavy oil fraction of hydrogenated tail oil is introduced into catalytic cracking reaction zone I, whereas said light oil fraction of hydrogenated tail oil is introduced into catalytic cracking reaction zone II. They contact catalytic cracking catalysts for reaction respectively. The catalytic cracking reaction conditions and the results are shown in Table 4.

Comparative Example 2

The feedstock oil to be processed, the catalyst to be used and the operational conditions of this comparative example are same as those of Example 2, except that hydrogenated tail oil is not separated and is introduced directly into catalytic cracking reaction zone I to be contacted with catalytic cracking catalysts for reaction in this comparative example. The properties of hydrogenated tail oil are shown in Table 3, and the catalytic cracking conditions and the results are shown in Table 4.

TABLE 1

| | Feedstock | | | | | |
|---|---|---|---|---|---|---|
| | A | | | B | | |
| | Component of Feedstock, wt % | | | | | |
| | Residual Oil | | | | | |
| | 90% | | | 80% | | |
| | Catalytic Cracking Cycle Oil | | | | | |
| | 10% | | | 20% | | |
| Properties | Catalytic Cracking Cycle Oil | Residual Oil | Blending feedstock for Hydrotreated Unit | Catalytic Cracking Cycle Oil | Residual Oil | Blending feedstock for Hydrotreated Unit |
| Density (20° C.), g/cm$^3$ | 0.9764 | 0.9795 | 0.9783 | 0.9764 | 0.9795 | 0.9789 |
| Viscosity (100° C.), mm$^2$/s | 8.396 | 68.19 | 55.69 | 8.396 | 68.19 | 49.23 |

TABLE 1-continued

| | Feedstock | | | | | |
|---|---|---|---|---|---|---|
| | A | | | B | | |
| | Component of Feedstock, wt % | | | | | |
| | Residual Oil | | | | | |
| | 90% | | | 80% | | |
| | Catalytic Cracking Cycle Oil | | | | | |
| | 10% | | | 20% | | |
| Properties | Catalytic Cracking Cycle Oil | Residual Oil | Blending feedstock for Hydrotreated Unit | Catalytic Cracking Cycle Oil | Residual Oil | Blending feedstock for Hydrotreated Unit |
| CCR, m % | 1.44 | 11.30 | 11.00 | 1.44 | 11.30 | 9.33 |
| Composition of Element, wt % | | | | | | |
| C/H | 87.76/10.58 | 85.44/11.02 | 85.67/10.98 | 87.76/10.58 | 85.44/11.02 | 85.90/10.93 |
| S/N | 1.30/0.26 | 3.00/0.44 | 2.83/0.42 | 1.3/0.26 | 3.00/0.44 | 2.66/0.40 |
| Content of Metal, wtppm | | | | | | |
| Ni/V | | 19.8/42.6 | 17.8/38.3 | | 19.8/42.6 | 15.8/34.1 |
| Fe/Ca/Na | | 10.7/0.7/1.9 | 9.6/0.6/1.7 | | 10.7/0.7/1.9 | 8.6/0.6/1.5 |
| Group composition, wt % | | | | | | |
| Saturated Hydrocarbons/Aromatics | 41.7/47.0 | 27.5/45.1 | 28.1/46.8 | 41.7/47.0 | 27.5/45.1 | 30.3/45.5 |
| Resins/Asphaltenes ($C_7$ Insoluble Substance) | 11.4/<0.1 | 23.9/3.5 | 22.7/2.4 | 11.4/<0.1 | 23.9/3.5 | 21.4/2.8 |
| Ni + V, wtppm | | 62.4 | 56.2 | | 62.4 | 49.9 |
| Content of Solid, wtppm | 10 | | | 10 | | |
| Particle Size (d(0.9)) | 5 | | | 5 | | |

TABLE 2

| | Feedstock of Hydrotreated Unit | |
|---|---|---|
| | Feedstock A | Feedstock B |
| Up-flow fixed Bed Reactor Hydrogen Mixed, $Nm^3/m^3$ | 21026 | 21930 |
| Down-flow fixed Bed Reactor Hydrogen Mixed, $Nm^3/m^3$ | 19627 | 19720 |
| $P_{H2}$, MPa | 15.1 | 15.1 |
| Reaction Temperature, ° C. | | |
| Up-flow fixed Bed Reactor | 393.5 | 393.8 |
| Down-flow fixed Bed Reactor | 394.0 | 394.2 |

TABLE 2-continued

| | | Feedstock of Hydrotreated Unit | |
|---|---|---|---|
| | | Feedstock A | Feedstock B |
| Item | Name of Stuff | | |
| Input, wt % | Residual Oil | 90 | 80 |
| | Catalytic Cracking Cycle Oil | 10 | 20 |
| | Pure Hydrogen | 1.30 | 1.35 |
| | Total | 101.30 | 101.35 |
| output, wt % | Hydrogen Sulfide | 2.18 | 2.14 |
| | Gas | 1.14 | 1.12 |
| | Hydrogenated Naphtha | 3.34 | 3.35 |
| | Hydrogenated Diesel Oil | 11.37 | 11.86 |
| | Hydrogenated Tail Oil | 83.08 | 82.67 |
| | Ammonia | 0.20 | 0.21 |
| | Total | 101.30 | 101.35 |

TABLE 3

| | Feedstock of hydrotreater | | | | | |
|---|---|---|---|---|---|---|
| | Feedstock A | | | Feedstock B | | |
| | Example | | | | | |
| | Example 1 | | Comparative Example 1 | Example 2 | | Comparative Example 2 |
| | Name of Stream | | | | | |
| | Light Fractional Oil | Heavy Fractional Oil | Hydrogenated Tail Oil | Light Fractional Oil | Heavy Fractional Oil | Hydrogenated Tail Oil |
| Proportion in Total Feedstock, wt % | 55 | 45 | 100 | 39 | 61 | 100 |
| Density (20° C.), g/cm3 | 0.9152 | 0.9367 | 0.9315 | 0.9103 | 0.9351 | 0.9253 |
| Residual Carbon, wt % | 1.5 | 8.02 | 4.43 | 0.5 | 5.76 | 3.71 |

TABLE 3-continued

| | Feedstock of hydrotreater | | | | | |
|---|---|---|---|---|---|---|
| | Feedstock A | | | Feedstock B | | |
| | Example | | | | | |
| | Example 1 | | Comparative Example 1 | Example 2 | | Comparative Example 2 |
| | Name of Stream | | | | | |
| | Light Fractional Oil | Heavy Fractional Oil | Hydrogenated Tail Oil | Light Fractional Oil | Heavy Fractional Oil | Hydrogenated Tail Oil |
| Composition of Element, wt % | | | | | | |
| C/H | 87.59/12.21 | 87.47/11.90 | 86.94/12.08 | 87.61/12.39 | 87.22/12.04 | 87.37/12.18 |
| S/N | 0.18/0.19 | 0.47/0.29 | 0.77/0.24 | 0.21/0.17 | 0.5/0.3 | 0.39/0.25 |
| Content of Metal, wtppm | | | | | | |
| Ni/V | | 3.40/7.00 | 1.53/3.15 | | 3.00/4.50 | 1.83/2.75 |
| Group composition, wt % | | | | | | |
| Saturated Hydrocarons | 67.8 | 51.7 | 60.56 | 68.7 | 52.4 | 58.76 |
| Aromatics | 30.3 | 37.3 | 33.45 | 27.7 | 35.8 | 32.64 |
| Resins | 1.9 | 10.3 | 5.68 | 3.6 | 10.6 | 7.87 |
| Asphaltenes ($C_7$ Insoluble Substance) | 0.1 | 0.7 | 0.37 | 0.1 | 1.2 | 0.77 |

TABLE 4

| | Feedstock of Hydrotreater | | | | | |
|---|---|---|---|---|---|---|
| | Feedstock A | | | Feedstock B | | |
| | Example | | | | | |
| | Example 1 | Comparative Example 1 | Difference | Example 2 | Comparative Example 2 | Difference |
| Reaction Condition of Reaction Zone II | | | | | | |
| Reaction Temperature, ° C. (Initial Contact Mixing) | 550.5 | | | 540 | | |
| Reaction Time, Second | 1.3 | | | 0.8 | | |
| Catalyst to Oil Ratio* | 12.7 | | | 15.4 | | |
| Reaction Condition of Reaction Zone I | | | | | | |
| Reaction Temperature, ° C. (Initial Contact mixing) | 620 | 621 | | 580 | 582 | |
| Reaction Time, Second | 1.5 | 3 | | 1.6 | 2.6 | |
| Catalyst to Oil Ratio* | 15.6 | | | 9.8 | | |
| Regeneration Temperature, ° C. | 713 | 713 | | 713 | 713 | |
| Regeneration Pressure (G), kPa | 229.9 | 230.3 | | 229.9 | 230.3 | |
| Total Reaction Time | 2.8 | 3 | | 2.4 | 2.6 | |
| Total Ratio of Catalyst to Oil* | 7 | 7 | | 6 | 6 | |
| Distribution of Products, wt % | | | | | | |
| Acidic Gas | 0.55 | 0.51 | 0.04 | 0.50 | 0.51 | −0.01 |
| Dry Gas | 4.26 | 4.33 | −0.07 | 4.00 | 4.10 | −0.10 |
| Liquefied Petroleum Gas | 15.84 | 15.45 | 0.39 | 15.00 | 14.80 | 0.20 |
| Stable Gasoline | 31.48 | 27.51 | 3.97 | 31.20 | 30.00 | 1.20 |
| Diesel Oil | 34.17 | 34.35 | −0.18 | 36.10 | 34.00 | 2.10 |
| Slurry Oil | 3.46 | 7.29 | −3.83 | 4.00 | 7.09 | −3.09 |
| Coke | 9.54 | 9.68 | −0.14 | 8.70 | 9.00 | −0.30 |
| Lost | 0.70 | 0.88 | | 0.50 | 0.50 | |
| Total | 100.00 | 100.00 | | 100.00 | 100.00 | |
| Conversion, wt % | 62.37 | 58.36 | 4.01 | 59.90 | 58.91 | 0.99 |
| Yield of Light Oil, wt % | 65.65 | 61.86 | 3.79 | 67.30 | 64.00 | 3.30 |
| Yield of Total Liquid, wt % | 81.49 | 77.31 | 4.18 | 82.30 | 78.80 | 3.50 |
| Yield of Propylene, wt % | 4.66 | 4.51 | 0.15 | 4.50 | 4.40 | 0.10 |

*Note: Catalyst to Oil Ratio refers to the mass ratio between the involved catalyst and the involved hydrocarbon oil in the reaction.

As shown by the results given in Table 4, the selectivity of gasoline and diesel oil in products' distribution is significantly improved in accordance with the method provided by the present invention, compared with the method of direct introduction of hydrogenated tail oil into catalytic cracking reaction equipment for conversion. For example, the feedstock oil in Example 1 is the same as that in Comparative Example 1, except that hydrogenated tail oil in Example 1 is separated into a light fraction and a heavy fraction under reduced pressure, and then is catalytically cracked in two different reaction zones, respectively. By comparison of the results provided by these two different processes, the conversion increases by about 4%, the yield of gasoline increases by 3.97%, the yield of coke decreases by 0.14%, and the total liquid yield increases by 4.18% in Example 1. The feedstock oil in Example 2 is the same as that in Comparative Example 2. By comparison of the results provided by these two different processes in Example 2 and Comparative Example 2, the conversion increases by about 1%, the yield of diesel oil increases 2.10%, the yield of gasoline increases by 1.2%, the yield of coke decreases by 0.3%, and the total liquid yield increases by 3.5% in Example 2.

The differences between Example 1 and Example 2 lie in the hydrotreating feedstock, the ratio of the light fraction to the heavy fraction obtained by vacuum distillation of hydrogenated tail oil, and the catalytic cracking reaction conditions. As seen from the reaction results, their products' distributions are also different. Wherein the conversion increases and the cracking product is lighter in Example 1, whereas the yield of diesel oil increases considerably in Example 2. As the results illustrate, the products' distribution of refined oils can be adjusted by varying the amount of catalytic cracking cycle oil in the hydrotreating feedstock (feedstock A and feedstock B), the ratio of the light fraction to the heavy fraction obtained from vacuum distillation of hydrogenated tail oil, and the catalytic cracking reaction conditions, at the same time higher conversion of the feedstock oil is ensured.

Example 3

This example illustrates the effect of the process in accordance with the scheme showed in FIG. 2.

In this example, feedstock oil A is used as the feedstock oil to be introduced into hydrotreating reaction equipment, and the reaction conditions of hydrotreating reaction and products' distribution of oils produced by hydrotreating are shown in Table 2. Hydrogenated tail oil produced herein is named as hydrogenated tail oil C, and feedstock E is a conventional catalytic cracking feedstock. Hydrogenated tail oil C is 20% by weight and feedstock E is 80% by weight, respectively, based on the total weight of the feedstock. Light oil fraction H (which has a distillation range from 350 to 500° C., and is 44% by weight, based on feedstock E) and heavy oil fraction G (which has a distillation point higher than 500° C., and is 56% by weight, based on feedstock E) of catalytic cracking feedstock oil are obtained by vacuum distillation of feedstock E, respectively. The properties of each feedstock are shown in Table 5-1. Said heavy oil fraction G and hydrogenated tail oil C are introduced together into catalytic cracking reaction zone I, whereas said light oil fraction H is introduced into catalytic cracking reaction zone II. They contact catalytic cracking catalysts for reaction, where the weight ratio of hydrogenated tail oil C to heavy oil fraction G in reaction zone I is 31:69. The catalytic cracking reaction conditions and the results are shown in Table 6-1.

Comparative Example 3

The feedstock oil to be processed, the catalyst to be used and the operational conditions of this comparative example are same as those of Example 3, wherein hydrogenated tail oil C is also 20% by weight and feedstock E is also 80% by weight, respectively, based on the total weight of the feedstock. The difference between this comparative example and Example 3 is that feedstock E is not separated and is introduced directly into catalytic cracking reaction zone I together with hydrogenated tail oil C to contact cracking catalysts for reaction. The properties of each feedstock are shown in Table 5-1. The catalytic cracking reaction conditions and the results are shown in Table 6-1.

Example 4

This example illustrates the effect of the process in accordance with the scheme showed in FIG. 2.

In this example, feedstock oil B is used as the feedstock oil to be introduced into hydrotreating reaction equipment, and the reaction conditions of hydrotreating reaction and products' distribution of oils produced by hydrotreating are shown in Table 2. Hydrogenated tail oil produced herein is named as hydrogenated tail oil D, and feedstock E is a conventional catalytic cracking feedstock (which is same as that in Example 3). Hydrogenated tail oil D is 70% by weight and feedstock E is 30% by weight, respectively, based on the total weight of the feedstock. Light oil fraction H (which has a distillation range from 350 to 500° C., and is 44% by weight, based on feedstock E) and heavy oil fraction G (which has a distillation range higher than 500° C., and is 56% by weight, based on feedstock E) of catalytic cracking feedstock oil are obtained by vacuum distillation of feedstock E, respectively. The properties of each feedstock are shown in Table 5-1. Said heavy oil fraction G and hydrogenated tail oil D are introduced together into catalytic cracking reaction zone I, whereas said light oil fraction H is introduced into catalytic cracking reaction zone II. They contact catalytic cracking catalysts for reaction, wherein the weight ratio of hydrogenated tail oil D to heavy oil fraction G in reaction zone I is 81:19. The catalytic cracking reaction conditions and the results are shown in Table 6-1.

Comparative Example 4

The feedstock oil to be processed, the catalyst to be used and the operational conditions of this comparative example are same as those of Example 4, wherein hydrogenated tail oil D is also 70% by weight and feedstock B is also 30% by weight, respectively, based on the total weight of the feedstock. The difference between this comparative example and Example 4 is that feedstock E is not separated and is introduced directly into catalytic cracking reaction zone I together with hydrogenated tail oil C to contact catalytic cracking catalysts for reaction. The properties of each feedstock are shown in Table 5-1 The catalytic cracking reaction conditions and the results are shown in Table 6-1.

Example 5

This example illustrates the effect of the process in accordance with the scheme showed in FIG. 3.

In this example, feedstock oil A is used as the feedstock oil to be introduced into hydrotreating reaction equipment, and the reaction conditions of hydrotreating reaction and products' distribution of oils produced by hydrotreating are shown in Table 2. Hydrogenated tail oil produced herein is named as hydrogenated tail oil C, and feedstock E is a conventional catalytic cracking feedstock (which is same as that in Example 3). Hydrogenated tail oil C is 20% by weight and feedstock E is 80% by weight, respectively, based on the total weight of the feedstock. Light oil fraction H (which has a distillation range from 350 to 500° C., and is 44% by weight, based on feedstock E) and heavy oil fraction G (which has a distillation range higher than 500° C., and is 56% by weight, based on feedstock E) of catalytic cracking feedstock oil are obtained by vacuum distillation of feedstock E, respectively. The properties of each feedstock are shown in Table 5-2. Said heavy oil fraction G is introduced alone into catalytic cracking reaction zone I, whereas said light oil fraction H and hydrogenated tail oil C are introduced into catalytic cracking reaction zone II. They contact catalytic cracking catalysts for reaction, wherein the weight ratio of hydrogenated tail oil C to light oil fraction H in reaction zone II is 34:66. The catalytic cracking reaction conditions and the results are shown in Table 6-2.

Comparative Example 5

The feedstock oil to be processed, the catalyst to be used and the operational conditions of this comparative example are same as those of Example 5, wherein hydrogenated tail oil C is also 20% by weight and feedstock E is 80% by weight, respectively, based on the total weight of the feedstock. The difference between them is that feedstock E is not separated and is introduced directly into catalytic cracking reaction zone I together with hydrogenated tail oil C to contact catalytic cracking catalysts for reaction. The properties of each feedstock are shown in Table 5-2. The catalytic cracking reaction conditions and the results are shown in Table 6-2.

Example 6

This example illustrates the effect of the process in accordance with the scheme showed in FIG. 3.

In this example, feedstock oil B is used as the feedstock oil to be introduced into hydrotreating reaction equipment, and the reaction conditions of hydrotreating reaction and products' distribution of oils produced by hydrotreating are shown in Table 2. Hydrogenated tail oil produced herein is named as hydrogenated tail oil D, and feedstock E is a conventional heavy oil catalytic cracking feedstock (which is same as that in Example 3). Hydrogenated tail oil D is 30% by weight and feedstock E is 70% by weight, respectively, based on the total weight of the feedstock. Light oil fraction H (which has a distillation range from 350 to 500° C., and is 44% by weight, based on feedstock E) and heavy oil fraction G (which has a distillation range higher than 500° C., and is 56% by weight, based on feedstock E) of catalytic cracking feedstock oil are obtained by vacuum distillation of feedstock E, respectively. The properties of each feedstock are shown in Table 5-2. Said heavy oil fraction G is introduced alone into catalytic cracking reaction zone I, whereas said light oil fraction H and hydrogenated tail oil D are introduced together into catalytic cracking reaction zone II. They contact catalytic cracking catalysts for reaction, wherein the weight ratio of hydrogenated tail oil D to light oil fraction H in reaction zone II is 49:51. The catalytic cracking reaction conditions and the results are shown in Table 6-2.

Comparative Example 6

The feedstock oil to be processed, the catalyst to be used and the operational conditions of this comparative example are same as those of Example 6, wherein hydrogenated tail oil D is also 30% by weight and feedstock E is also 70% by weight, respectively, based on the total weight of the feedstock. The difference between them is that feedstock E is not separated and is introduced directly, together with hydrogenated tail oil D, into catalytic cracking reaction zone I to contact catalytic cracking catalysts for reaction. The property of each feedstock is shown in Table 5-2. The catalytic cracking reaction conditions and the results are shown in Table 6-2.

Example 7

This example illustrates the effect of the process in accordance with the scheme showed in FIG. 1.

In this example, feedstock oil B is used as the feedstock oil to be introduced into hydrotreating reaction equipment, and the reaction conditions of hydrotreating reaction and products' distribution of oils produced by hydrotreating are shown in Table 2. Hydrogenated tail oil produced herein is named as hydrogenated tail oil D, and feedstock E is a conventional heavy oil catalytic cracking feedstock. Hydrogenated tail oil D is 30% by weight and feedstock E is 70% by weight, respectively, based on the total weight of the feedstock. Light oil fraction H (which has a distillation range from 350 to 500° C., and is 44% by weight, based on feedstock E) and heavy oil fraction G (which has a distillation range higher than 500° C., and is 56% by weight, based on feedstock E) of catalytic cracking feedstock oil are obtained by vacuum distillation of feedstock E. Light oil fraction (39% by weight, based on the total weight of hydrogenated tail oil) and heavy oil fraction (61% by weight, based on the total weight of hydrogenated tail oil D) of hydrogenated tail oil D are produced by vacuum distillation. The properties of each feedstock are shown in Table 5-3. Said heavy oil fraction G and said heavy oil fraction of hydrogenated tail oil D are introduced into catalytic cracking reaction zone I, whereas said light oil fraction H and said light oil fraction of hydrogenated tail oil D are introduced into catalytic cracking reaction zone II. They contact catalytic cracking catalysts for reaction and the catalytic cracking reaction conditions and the results are shown in Table 6-3.

Comparative Example 7

The feedstock oil to be processed, the catalyst to be used and the operational conditions of this comparative example are same as those of Example 7, wherein hydrogenated tail oil D is also 30% by weight and feedstock E is also 70% by weight, respectively, based on the total weight of the feedstock. The difference between Comparative Example 7 and Example 7 is that feedstock E and hydrogenated tail oil D have not been separated and are introduced directly by mixing into catalytic cracking reaction zone I to contact catalytic cracking catalysts for reaction. The property of each feedstock is shown in Table 5-3. The catalytic cracking reaction conditions and the results are shown in Table 6-3.

TABLE 5-1

| | Feedstock of Hydrotreater | | | | | | | | | |
|---|---|---|---|---|---|---|---|---|---|---|
| | Feedstock A | | | | | Feedstock B | | | | |
| | Example | | | | | | | | | |
| | Example 3 | | | Comparative Example 3 | | Example 4 | | | Comparative Example 4 | |
| | Feedstock of Catalytic Cracker Reaction Zone | | | | | | | | | |
| | Reaction Zone II | Reaction Zone I | | Reaction Zone I | | Reaction Zone II | Reaction Zone I | | Reaction Zone I | |
| | Name of Stream | | | | | | | | | |
| | Light Fractional Oil H | Hydrogenated Tail Oil C | Heavy Fractional Oil G | Feedstock E | Hydrogenated Tail Oil C | Light Fractional Oil H | Hydrogenated Tail Oil D | Heavy Fractional Oil G | Feedstock E | Hydro-genated Tail Oil D |
| Proportion in Total Feedstock, wt % | 35.2 | 20.0 | 44.8 | 80.0 | 20.0 | 13.2 | 70.0 | 16.8 | 30.0 | 70.0 |
| Density (20° C.), g/cm3 | 0.9103 | 0.9315 | 0.9580 | 0.9351 | 0.9315 | 0.9103 | 0.9253 | 0.9580 | 0.9351 | 0.9253 |
| Residual Carbon, wt % | 0.2 | 4.43 | 9.76 | 5.07 | 4.43 | 0.2 | 3.71 | 9.76 | 5.07 | 3.71 |
| Composition of Element, wt % | | | | | | | | | | |
| C | 87.61 | 86.94 | 87.68 | 87.22 | 86.94 | 87.61 | 87.37 | 87.68 | 87.22 | 87.37 |
| H | 12.39 | 12.08 | 11.64 | 12.04 | 12.08 | 12.39 | 12.18 | 11.64 | 12.04 | 12.18 |
| S | 0.21 | 0.77 | 0.74 | 0.50 | 0.77 | 0.21 | 0.39 | 0.74 | 0.50 | 0.39 |
| N | 0.17 | 0.27 | 0.27 | 0.24 | 0.27 | 0.17 | 0.25 | 0.27 | 0.24 | 0.25 |
| Content of Metal, wtppm | | | | | | | | | | |
| Ni | | 1.53 | 8.80 | 4.70 | 1.53 | | 1.83 | 8.80 | 4.70 | 1.83 |
| V | | 3.15 | 10.80 | 5.70 | 3.15 | | 2.75 | 10.80 | 5.70 | 2.75 |
| Group composition, wt % | | | | | | | | | | |
| Saturated Hydrocarons | | 60.6 | 38.7 | 52.4 | 60.6 | | 58.8 | 38.7 | 52.4 | 58.8 |
| Aromatics | | 33.5 | 43.3 | 35.8 | 33.5 | | 32.6 | 43.3 | 35.8 | 32.6 |
| Resins | | 5.7 | 15.9 | 10.6 | 5.7 | | 7.9 | 15.9 | 10.6 | 7.9 |
| Asphaltenes ($C_7$ Insoluble Substance) | | 0.4 | 2.1 | 1.2 | 0.4 | | 0.8 | 2.1 | 1.2 | 0.8 |
| Ni + V, ppm | | 4.68 | 19.60 | 10.40 | 4.68 | | 4.58 | 19.60 | 10.40 | 4.58 |

TABLE 5-2

| | Feedstock of Hydrotreater | | | | | | | | | |
|---|---|---|---|---|---|---|---|---|---|---|
| | Feedstock A | | | | | Feedstock B | | | | |
| | Example | | | | | | | | | |
| | Example 5 | | | Comparative Example 5 | | Example 6 | | | Comparative Example 6 | |
| | Feedstock of Catalytic Cracker Reaction Zone | | | | | | | | | |
| | Reaction Zone II | | Reaction Zone I | Reaction Zone I | | Reaction Zone II | | Reaction Zone I | Reaction Zone I | |
| | Name of Stream | | | | | | | | | |
| | Light Fractional Oil H | Hydrogenated Tail Oil C | Heavy Fractional Oil G | Feedstock E | Hydrogenated Tail Oil C | Light Fractional Oil H | Hydrogenated Tail Oil D | Heavy Fractional Oil G | Feedstock E | Hydro-genated Tail Oil D |
| Proportion in Total Feedstock, wt % | 35.2 | 20.0 | 44.8 | 80.0 | 20.0 | 30.8 | 30.0 | 39.2 | 70.0 | 30.0 |
| Density (20° C.), g/cm3 | 0.9103 | 0.9315 | 0.9580 | 0.9351 | 0.9315 | 0.9103 | 0.9253 | 0.9580 | 0.9351 | 0.9253 |
| Residual Carbon, wt % | 0.2 | 4.43 | 9.76 | 5.07 | 4.43 | 0.2 | 3.71 | 9.76 | 5.07 | 3.71 |
| Composition of Element, wt % | | | | | | | | | | |
| C | 87.61 | 86.94 | 87.68 | 87.22 | 86.94 | 87.61 | 87.37 | 87.68 | 87.22 | 87.37 |
| H | 12.39 | 12.08 | 11.64 | 12.04 | 12.08 | 12.39 | 12.18 | 11.64 | 12.04 | 12.18 |
| S | 0.21 | 0.77 | 0.74 | 0.50 | 0.77 | 0.21 | 0.39 | 0.74 | 0.50 | 0.39 |
| N | 0.17 | 0.27 | 0.27 | 0.24 | 0.27 | 0.17 | 0.25 | 0.27 | 0.24 | 0.25 |
| Content of Metal, ppm | | | | | | | | | | |
| Ni | | 1.53 | 8.80 | 4.70 | 1.53 | | 1.83 | 8.80 | 4.70 | 1.83 |
| V | | 3.15 | 10.80 | 5.70 | 3.15 | | 2.75 | 10.80 | 5.70 | 2.75 |
| Group composition, wt % | | | | | | | | | | |
| Saturated Hydrocarons | | 60.6 | 38.7 | 52.4 | 60.6 | | 58.8 | 38.7 | 52.4 | 58.8 |
| Aromatics | | 33.5 | 43.3 | 35.8 | 33.5 | | 32.6 | 43.3 | 35.8 | 32.6 |
| Resins | | 5.7 | 15.9 | 10.6 | 5.7 | | 7.9 | 15.9 | 10.6 | 7.9 |
| Asphaltenes ($C_7$ Insoluble Substance) | | 0.4 | 2.1 | 1.2 | 0.4 | | 0.8 | 2.1 | 1.2 | 0.8 |
| Ni + V, ppm | | 4.68 | 19.60 | 10.40 | 4.68 | | 4.58 | 19.60 | 10.40 | 4.58 |

TABLE 5-3

| | Feedstock of Hydrotreater Feedstock B Example | | | | | |
|---|---|---|---|---|---|---|
| | Example 7 | | | | | Comparative Example 7 |
| | Feedstock of Catalytic Cracker Reaction Zone | | | | | |
| | Reaction zone II | | Reaction zone I | | | Reaction zone I |
| | Name of Stream | | | | | |
| | Light Fractional Oil H | Light oil fraction of Hydrogenated Tail Oil D | Heavy oil fraction of Hydrogenated Tail Oil D | Heavy Fractional Oil G | Feedstock E | Hydrogenated Tail Oil D |
| Proportion in Total Feedstock, wt % | 30.8 | 11.7 | 18.3 | 39.2 | 70.0 | 30.0 |
| Density (20° C.), g/cm3 | 0.9103 | 0.9103 | 0.9351 | 0.9580 | 0.9351 | 0.9253 |
| Residual Carbon, wt % | 0.2 | 0.2 | 5.76 | 9.76 | 5.07 | 3.71 |
| Composition of Element, wt % | | | | | | |
| C | 87.61 | 87.61 | 87.22 | 87.68 | 87.22 | 87.37 |
| H | 12.39 | 12.39 | 12.04 | 11.64 | 12.04 | 12.18 |
| S | 0.21 | 0.21 | 0.50 | 0.74 | 0.50 | 0.39 |
| N | 0.17 | 0.17 | 0.30 | 0.27 | 0.24 | 0.25 |

TABLE 5-3-continued

| | Feedstock of Hydrotreater Feedstock B Example | | | | | |
|---|---|---|---|---|---|---|
| | Example 7 Feedstock of Catalytic Cracker Reaction Zone | | | | | Comparative Example 7 |
| | Reaction zone II | | Reaction zone I | | | Reaction zone I |
| | Name of Stream | | | | | |
| | Light Fractional Oil H | Light oil fraction of Hydrogenated Tail Oil D | Heavy oil fraction of Hydrogenated Tail Oil D | Heavy Fractional Oil G | Feedstock E | Hydrogenated Tail Oil D |
| Content of Metal, ppm | | | | | | |
| Ni | | | 3.00 | 8.80 | 4.70 | 1.83 |
| V | | | 4.50 | 10.80 | 5.70 | 2.75 |
| Group composition, wt % | | | | | | |
| Saturated Hydrocarons | | 68.7 | 52.4 | 38.7 | 52.4 | 58.8 |
| Aromatics | | 27.7 | 35.8 | 43.3 | 35.8 | 32.6 |
| Resins | | 3.6 | 10.6 | 15.9 | 10.6 | 7.9 |
| Asphaltenes ($C_7$ Insoluble Substance) | | 0.1 | 1.2 | 2.1 | 1.2 | 0.8 |
| Ni + V, ppm | | | 7.50 | 19.60 | 10.40 | 4.58 |

TABLE 6-1

| | Feedstock of Hydrotreater | | | | | |
|---|---|---|---|---|---|---|
| | Feedstock A | | | Feedstock B | | |
| | Example | | | | | |
| | Example 3 | Comparative Example 3 | Difference | Example 4 | Comparative Example 4 | Difference |
| Reaction Conditions of Reaction Zone II | | | | | | |
| Reaction Temperature, ° C. (Initial Contact Mixing) | 550 | | | 540 | | |
| Reaction Time, Second | 1.8 | | | 1.0 | | |
| Operational Ratio of Catalyst to Oil | 19.9 | | | 37.9 | | |
| Reaction Conditions of Reaction Zone I | | | | | | |
| Reaction Temperature, ° C. (Initial Contact Mixing) | 640 | 640 | | 580 | 582 | |
| Reaction Time, Second | 1.1 | 3 | | 1.5 | 2.6 | |
| Operational Ratio of Catalyst to Oil* | 10.8 | | | 5.8 | | |
| Regeneration Temperature, ° C. | 713 | 713 | | 713 | 713 | |
| Regeneration Pressure (G), kPa | 229.9 | 230.3 | | 229.9 | 230.3 | |
| Total Apparent Cycle Ratio* | 0.12 | 0.12 | | 0.24 | 0.24 | |
| Total Reaction Time* | 2.9 | 3 | | 2.4 | 2.6 | |
| Total Ratio of Catalyst to Oil* | 7 | 7 | | 5 | 5 | |
| Distribution of Products, wt % | | | | | | |
| Acidic Gas | 0.55 | 0.51 | 0.04 | 0.50 | 0.51 | −0.01 |
| Dry Gas | 4.26 | 4.33 | −0.07 | 4.00 | 4.10 | −0.10 |
| liquefied petroleum Gas | 15.84 | 15.45 | 0.39 | 15.00 | 14.80 | 0.20 |
| Stable Gasoline | 38.60 | 36.83 | 1.77 | 34.20 | 33.00 | 1.20 |
| Diesel Oil | 27.85 | 27.50 | 0.35 | 33.10 | 31.00 | 2.10 |
| Oil Slurry | 3.00 | 5.20 | −2.20 | 4.00 | 7.09 | −3.09 |
| Coke | 9.40 | 9.68 | −0.28 | 8.70 | 9.00 | −0.30 |
| Lost | 0.50 | 0.50 | | 0.50 | 0.50 | |
| Total | 100.00 | 100.00 | | 100.00 | 100.00 | |
| Conversion, wt % | 69.15 | 67.30 | 1.85 | 62.90 | 61.91 | 0.99 |
| Yield of light oil, wt % | 66.45 | 64.33 | 2.12 | 67.30 | 64.00 | 3.30 |
| Yield of total liquid, wt % | 82.29 | 79.78 | 2.51 | 82.30 | 78.80 | 3.50 |
| Yield of propylene, wt % | 4.80 | 4.50 | 0.30 | 4.50 | 4.30 | 0.20 |

*Note: Operational Ratio of Catalyst to Oil in certain reaction zone refers to the mass ratio between the involved catalyst and the involved feedstock oil in the certain reaction zone; Total Ratio of Catalyst to Oil refers to the mass ratio between the involved catalyst and the total involved feedstock oil in the whole reactor; Total Apparent Cycle Ratio refers to the mass ratio between the involved cycle oil (HCO) and the involved fresh catalytic cracking feedstock in the reaction; Total Reaction Time refers to the total time during which hydrocarbon oils stay in the reaction zone I and II of a riser reactor.

TABLE 6-2

| | Feedstock of Hydrotreater | | | | | |
|---|---|---|---|---|---|---|
| | Feedstock A | | | Feedstock B | | |
| | Example | | | | | |
| | Example 5 | Comparative Example 5 | Difference | Example 6 | Comparative Example 6 | Difference |
| Reaction Conditions of Reaction Zone II | | | | | | |
| Reaction Temperature, ° C. (Initial Contact Mixing) | 570 | | | 540 | | |
| Reaction Time, Second | 1.7 | | | 1.4 | | |
| Operational Ratio of Catalyst to Oil | 13.2 | | | 9.9 | | |
| Reaction Conditions of Reaction Zone I | | | | | | |
| Reaction Temperature, ° C. (Initial Contact Mixing) | 580 | 600 | | 560 | 580 | |
| Reaction Time, Second | 1 | 2.9 | | 1.2 | 2.6 | |
| Operational Ratio of Catalyst to Oil | 15.6 | | | 15.3 | | |
| Regeneration Temperature, ° C. | 713 | 713 | | 713 | 713 | |
| Regeneration Pressure (G), kPa | 229.9 | 230.3 | | 229.9 | 230.3 | |
| Total Apparent Cycle Ratio | 0.12 | 0.12 | | 0.24 | 0.24 | |
| Total Reaction Time | 2.7 | 2.9 | | 2.6 | 2.6 | |
| Total Ratio of Catalyst to Oil | 7 | 7 | | 6 | 6 | |
| Distribution of Products, wt % | | | | | | |
| Acidic Gas | 0.45 | 0.40 | 0.05 | 0.43 | 0.39 | 0.04 |
| Dry Gas | 3.50 | 4.20 | −0.70 | 3.10 | 3.90 | −0.80 |
| liquefied petroleum Gas | 14.50 | 14.30 | 0.20 | 14.30 | 13.80 | 0.50 |
| Stable Gasoline | 37.50 | 34.80 | 2.70 | 35.50 | 34.31 | 1.19 |
| Diesel oil | 31.05 | 31.00 | 0.05 | 33.10 | 31.00 | 2.10 |
| Oil Slurry | 3.80 | 5.80 | −2.00 | 4.50 | 7.40 | −2.90 |
| Coke | 8.70 | 9.00 | −0.30 | 8.57 | 8.70 | −0.13 |
| Lost | 0.50 | 0.50 | | 0.50 | 0.50 | |
| Total | 100.00 | 100.00 | | 100.00 | 100.00 | |
| Conversion, wt % | 65.15 | 63.20 | 1.95 | 62.40 | 61.60 | 0.80 |
| Yield of Light Oil, wt % | 68.55 | 65.80 | 2.75 | 68.60 | 65.31 | 3.29 |
| Yield of total Liquid, wt % | 83.05 | 80.10 | 2.95 | 82.90 | 79.11 | 3.79 |
| Yield of Ppropylene, wt % | 4.20 | 4.00 | 0.20 | 4.00 | 3.70 | 0.30 |

TABLE 6-3

| | Feedstock of Hydrotreater Feedstock B | | |
|---|---|---|---|
| | Example | | |
| | Example 7 | Comparative Example 7 | Difference |
| Reaction Conditions of Reaction Zone II | | | |
| Reaction Temperature, ° C. (Initial Contact Mixing) | 545 | | |
| Reaction Time, Second | 1.4 | | |
| Operational Ratio of Catalyst to Oil | 14 | | |
| Reaction Conditions of Reaction Zone I | | | |
| Reaction Temperature, ° C. (Initial Contact Mixing) | 585 | 585 | |
| Reaction Time, Second | 1.5 | 3 | |
| Operational Ratio of Catalyst to Oil | 10.4 | | |
| Regeneration Temperature, ° C. | 713 | 713 | |
| Regeneration Pressure (G), kPa | 229.9 | 230.3 | |
| Total Apparent Cycle Ratio | 0.24 | 0.24 | |
| Total Reaction Time | 2.9 | 3 | |
| Total Ratio of Catalyst to Oil | 6 | 6 | |
| Distribution of Products, wt % | | | |
| Acidic Gas | 0.51 | 0.51 | |
| Dry Gas | 4.40 | 4.30 | 0.10 |
| liquefied petroleum Gas | 15.50 | 15.10 | 0.40 |
| Stable Gasoline | 37.00 | 34.50 | 2.50 |
| Diesel Oil | 30.00 | 29.00 | 1.00 |

TABLE 6-3-continued

| | Feedstock of Hydrotreater Feedstock B | | |
|---|---|---|---|
| | Example | | |
| | Example 7 | Comparative Example 7 | Difference |
| Oil Slurry | 3.20 | 6.79 | −3.59 |
| Coke | 8.89 | 9.30 | −0.41 |
| Lost | 0.50 | 0.50 | |
| Total | 100.00 | 100.00 | |
| Conversion, wt % | 66.80 | 64.21 | 2.59 |
| Yield of light oil, wt % | 67.00 | 63.50 | 3.50 |
| Yield of total liquid, wt % | 82.50 | 78.60 | 3.90 |
| Yield of propylene, wt % | 4.70 | 4.35 | 0.35 |

As shown by the results given in Table 6-1, the selectivity of gasoline and diesel oil in products' distribution is significantly improved in accordance with the method provided by the present invention, compared with the method of direct introduction of hydrogenated tail oil into catalytic cracking reaction equipment for conversion. For example, the feedstock oil processed in Example 3 is the same as that in Comparative Example 3, except that the hydrocarbon oil in Example 3 is separated into a light fraction and a heavy fraction under reduced pressure, wherein the heavy fraction is combined with hydrogenated tail oil, and then is catalytically cracked in two different reaction zones, respectively. By comparison of the results provided by said two different processes, the conversion increases by about 1.85%, the yield of gasoline and diesel oil increases by 2.12%, the yield of coke decreases by 0.28%, and the total liquid yield increases by 2.51% in Example 3. The yield of oil slurry decreases by 2.20%, which illustrates that the conversion capability of the heavy oil increases significantly. The feedstock oil processed in Comparative Example 4 is same as that in Example 4. By comparison of the results provided by these two different processes of Example 4 and Comparative Example 4, the conversion increases by about 1%, the yield of diesel oil increases 2.10%, the yield of gasoline increases by 1.2%, the yield of coke decreases by 0.3%, and the total liquid yield increases by 3.5% in Example 4.

As shown by the results given in Table 6-2, compared with the method of direct introduction of hydrocarbon oil into catalytic cracking reaction equipment for conversion, the selectivity of gasoline and diesel oil in products' distribution is significantly improved according to the method of the present invention with the intensified adjustment of reaction conditions of reaction zone II by adding high temperature regenerated catalyst, at the same time low-value products decrease, and in particular the yield of dry gas decreases, which further increases the conversion efficiency of the catalytic cracking equipment. For example, the feedstock oil processed in Example 5 is same as that in Comparative Example 5, and the difference lies in that the hydrocarbon oil in Example 5 is separated into a light fraction and a heavy fraction under reduced pressure, wherein the light fraction is combined with hydrogenated tail oil, and then is catalytically cracked in two different reaction zones, respectively. By comparison of the results provided by these two different processes, the conversion increases by about 1.95%, the yield of gasoline and diesel oil increases by 2.75%, the yield of coke decreases by 0.30%, the total liquid yield increases by 2.95%, the yield of dry gas decreases 0.70%, and the products' distribution efficiency increases significantly in Example 5. The feedstock oil processed in Example 6 is same as that in Comparative Example 6. By comparison of the results provided by said two different processes, the conversion increases by about 0.8%, the yield of diesel oil increases by 2.10%, the yield of gasoline increases by 1.19%, the yield of coke decreases by 0.13%, the total liquid yield increases by 3.79%, and the yield of dry gas decreases 0.80% in Example 6. The yield of oil slurry decreases 2.90%, which illustrates that the conversion capability of the heavy oil increases significantly.

As shown by the results given in Table 6-3, compared with the method of direct introduction of hydrocarbon oil into catalytic cracking reaction equipment for conversion, the selectivity of gasoline and diesel oil in products' distribution is significantly improved according to the method of the present invention even at a lower reaction temperature. For example, the feedstock oil processed in Example 7 is same as that in Comparative Example 7, and the difference lies in that the feedstocks in Example 7 are separated into light and heavy fractions under reduced pressure, wherein the light and heavy fractions are catalytically cracked in two different reaction zones, respectively. By comparison of the results provided by these two different processes, the conversion increases by about 2.59%, the yield of gasoline and diesel oil increases by 3.50%, the yield of coke decreases by 0.41%, the total liquid yield increases by 3.90%, the yield of oil slurry decreases 3.59%, which illustrates that the conversion capability of the heavy oil and the yield of gasoline increase significantly.

The differences between Example 3 and Example 4 lie in the hydrotreating feedstock, the ratio of hydrogenated tail oil to the total feedstock, and the catalytic cracking reaction conditions. As seen from the reaction results, their products' distributions are different. The conversion increases and the cracking product is lighter in Example 3, whereas the yield of diesel oil increases considerably in Example 4. As the results illustrate, the products' distribution of refined oils may be adjusted by varying the amount of catalytic cracking cycle oil in the hydrotreating feedstock (feedstock A and feedstock B), the ratio of hydrogenated tail oil to the heavy fractional oil, and the catalytic cracking reaction conditions, at the same time higher conversion of the feedstock oil is ensured.

By comparison of Examples 5, 6 and Examples 3, 4, it is found that the yield of low-value products may be further decreased and the conversion efficiency of the catalytic cracking equipment may be increased by adjusting the mode in which the catalyst participating in the reaction to intensify the working conditions of different reaction zones.

Many variations and modifications may be made to the above-described embodiments. All such modifications and variations are intended to be included herein within the scope of this disclosure and protected by the following claims.

What is claimed is:

1. An improved combined method of hydrotreating and catalytic cracking of hydrocarbon oil, comprising:

contacting residual oil, catalytic cracking cycle oil, and optional distillate oil with a hydrotreating catalyst under hydrotreating conditions in the presence of hydrogen followed by separation of the reaction products to obtain gas, hydrogenated naphtha, hydrogenated diesel oil, and hydrogenated tail oil;

contacting the hydrogenated tail oil and normal catalytic cracking feedstock oil with a catalytic cracking catalyst under catalytic cracking conditions followed by separation of the reaction products to obtain dry gas, liquefied petroleum gas, catalytically cracked gasoline, catalytically cracked diesel oil, and catalytic cracking cycle oil;

wherein the catalytic cracking cycle oil comprises less than 30 wtppm of solid particles, and the size of the solid particles being less than 10 μm;

the contact reaction with the cracking catalyst is carried out in a reactor having at least two reaction zones I and II along the flow direction of reactants;

prior to contacting the hydrogenated tail oil and the normal catalytic cracking feedstock oil with the cracking catalyst, at least a portion of the normal catalytic cracking feedstock oil is separated into normal catalytic cracking heavy feedstock oil and normal catalytic cracking light feedstock oil, and the hydrogenated tail oil is optionally separated into at least two fractions, the light and the heavy fractions of the hydrogenated tail oil, wherein the normal catalytic cracking heavy feedstock oil and the optionally separated heavy fraction of the hydrogenated tail oil have a boiling point above 500° C., and the normal catalytic cracking light feedstock oil and the optionally separated light fraction of the hydrogenated tail oil have a distillation range of 350~500° C., wherein the contact reaction with the cracking catalyst comprises:

(i) charging the reaction zone I with one of normal catalytic cracking heavy feedstock oil and normal catalytic cracking light feedstock oil, optionally with unseparated normal catalytic cracking feedstock oil; whereas charging the reaction zone II with the other of normal catalytic cracking heavy feedstock oil and normal catalytic cracking light feedstock oil, optionally with unseparated normal catalytic cracking feedstock oil, and (ii) prior to the contact reaction, combining at least one of the normal catalytic cracking heavy feedstock oil and the normal catalytic cracking light feedstock oil with at least one feed chosen from unseparated hydrogenated tail oil, the light fraction of the hydrogenated tail, and the heavy fraction of the hydrogenated tail oil.

2. The method according to claim 1, wherein said contact reaction with catalytic cracking catalysts is carried out by charging the reaction zone I with normal catalytic cracking heavy feedstock oil and unseparated hydrogenated tail oil, whereas charging the reaction zone II with said normal catalytic cracking light feedstock oil.

3. The method according to claim 2, wherein the amount of hydrogenated tail oil is no more than 90% by weight, based on the mixed feedstock of normal catalytic cracking heavy feedstock oil and unseparated hydrogenated tail oil.

4. The method according to claim 2, wherein the reaction conditions in the reaction zone I are as follows: a reaction temperature of 550-700° C., a catalyst to oil ratio of 4-20, a reaction time of 0.5-10 seconds, an amount of 2-50 wt % of atomized water steam in the feedstock, and a reaction pressure of from normal pressure to 300 kPa; the reaction conditions in the reaction zone H are as follows: a reaction temperature of 500-600° C., a catalyst to oil ratio of 7-50, a reaction time of 0.2-8 seconds, an amount of 2-20 wt % of atomized water steam in the feedstock, and a reaction pressure of from normal pressure to 300 kPa.

5. The method according to claim 2, wherein the reaction conditions in the reaction zone I are as follows: a reaction temperature of 560-650° C., a catalyst to oil ratio of 5-16, a reaction time of 1-2 seconds, an amount of 5-10 wt % of atomized water steam in the feedstock, and a reaction pressure of 100-300 kPa; the reaction conditions in the reaction zone II are as follows: a reaction temperature of 510-560° C., a catalyst to oil ratio of 8-40, a reaction time of 0.5-1.5 seconds, an amount of 4-8 wt % of atomized water steam in the feedstock, and a reaction pressure of 100-300 kPa.

6. The method according to claim 1, wherein said contact reaction with catalytic cracking catalysts is carried out by charging the reaction zone I with said normal catalytic cracking heavy feedstock oil and optionally with unseparated normal catalytic cracking feedstock oil, whereas charging the reaction zone II with said normal catalytic cracking light feedstock oil and unseparated hydrogenated tail oil.

7. The method according to claim 6, wherein the amount of hydrogenated tail oil is no more than 50% by weight, based on the mixed feedstock of said normal catalytic cracking light feedstock oil and unseparated hydrogenated tail oil.

8. The method according to claim 6, wherein the reaction conditions in the reaction zone I are as follows: a reaction temperature of 550-700° C., a catalyst to oil ratio of 4-20, a reaction time of 0.5-10 seconds, an amount of 2-50 wt % of atomized water steam in the feedstock, and a reaction pressure of from normal pressure to 300 kPa; the reaction conditions in the reaction zone II are as follows: a reaction temperature of 500-600° C., a catalyst to oil ratio of 7-50, a reaction time of 0.2-8 seconds, an amount of 2-20 wt % of atomized water steam in the feedstock, and a reaction pressure of from normal pressure to 300 kPa.

9. The method according to claim 6, wherein the reaction conditions in the reaction zone I are as follows: a reaction temperature of 560-650° C., a catalyst to oil ratio of 5-16, a reaction time of 1-1.5 seconds, an amount of 5-10wt % of atomized water steam in the feedstock, and a reaction pressure of 100-300 kPa; the reaction conditions in the reaction zone 11 are as follows: a reaction temperature of 520-560° C., a catalyst to oil ratio of 8-40, a reaction time of 1-2 seconds, an amount of 4-8 wt % of atomized water steam in the feedstock, and a reaction pressure of 100-300 kPa.

10. The method according to claim 1, wherein regenerated catalysts may be introduced into said reaction zone II.

11. The method according to claim 1, wherein a delivery device for regenerated catalysts is provided between said reaction zone II and a cracking catalyst regenerator.

12. The method according to claim 11, wherein the delivery device for regenerated catalysts is equipped at a position of the reaction zone II such that the residence time of hydrocarbon oils in the reaction zone II is not less than 0.2 second.

13. The method according to claim 12, wherein the delivery device for regenerated catalysts is equipped at a position of the reaction zone H such that the residence time of hydrocarbon oils in the reaction zone II is not less than 1 second.

14. The method according to claim 1, wherein the content of said solid particles in the catalytic cracking cycle oil is less than 15 wtppm, and the particle size of said solid particles is less than 5 μm.

15. The method according to claim 1, wherein the step of removing cracking catalyst particles from catalytic cracking cycle oil is carried out by distillation and/or filtering.

16. The method according to claim 15, wherein the operation temperature is 100~350° C. during said filtering.

17. The method according to claim 16, wherein the operation temperature is 200~320° C. during said filtering.

18. The method according to claim 1, wherein the catalytic cracking cycle oil is selected from heavy cycle oil with cracking catalyst particles being removed, clarified oil with cracking catalyst particles being removed, the whole catalytically cracked product heavy oil with cracking catalyst particles and catalytically cracked diesel oil being removed, or a mixture of one or more of the above oils.

19. The method according to claim 1, wherein the amount of the catalytic cracking cycle oil is 5-40 wt %, based on the total weight of the residual oil, the catalytic cracking cycle oil, and the optional distillate oil to be contacted with the hydrotreating catalyst.

20. The method according to claim 1, wherein the reaction conditions in the reaction zone I are as follows: a reaction temperature of 550-700° C., a catalyst to oil ratio of 4-50, a reaction time of 0.5 second to 10 seconds, an amount of 2-50 wt % of atomized water steam in the feedstock, and a reaction pressure of from normal pressure to 300 kPa; the reaction conditions in the reaction zone II are as follows: a reaction temperature of 500-600° C., a catalyst to oil ratio of 3-50, a reaction time of 0.2 second to 8 seconds, an amount of 2-20 wt % of atomized water steam in the feedstock, and a reaction pressure of from normal pressure to 300 kPa.

21. The method according to claim 1, wherein the reaction conditions in the reaction zone I are as follows: a reaction temperature of 560-650° C., a catalyst to oil ratio of 7-20, a reaction time of from 1 second to 2 seconds, an amount of 5-10 wt % of atomized water steam in the feedstock, and a reaction pressure of 100-300 kPa; the reaction conditions in the reaction zone II are as follows: a reaction temperature of 510-560° C., a catalyst to oil ratio of 5-40, a reaction time of 0.5 second to 1.5 seconds, an amount of 4-8 wt % of atomized water steam in the feedstock, and a reaction pressure of 100-300 kPa.

* * * * *